US010935306B2

(12) United States Patent
Cho

(10) Patent No.: US 10,935,306 B2
(45) **Date of Patent: *Mar. 2, 2021**

(54) REFRIGERATOR

(71) Applicant: LG Electronics Inc., Seoul (KR)

(72) Inventor: Jeheon Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/557,665

(22) Filed: Aug. 30, 2019

(65) Prior Publication Data

US 2020/0072533 A1 Mar. 5, 2020

(30) Foreign Application Priority Data

Aug. 30, 2018 (KR) ..... 10-2018-0102975

(51) Int. Cl.
*F25D 25/02* (2006.01)
*F25D 23/02* (2006.01)
(Continued)

(52) U.S. Cl.
CPC ..... *F25D 25/025* (2013.01); *E05B 65/463* (2013.01); *F25D 23/028* (2013.01);
(Continued)

(58) Field of Classification Search
CPC ..... F25D 23/028; F25D 25/025; F25D 29/00; F25D 2323/02; F25D 2500/02;
(Continued)

(56) References Cited

U.S. PATENT DOCUMENTS 4,077,684 A * 3/1978 Scherrer ..... E05B 65/463 312/220
8,002,230 B2 * 8/2011 Kempte ..... A47B 77/02 248/501
(Continued)

FOREIGN PATENT DOCUMENTS

AT 508689 A2 * 3/2011 ..... A47B 88/70
DE 8815528 U1 * 2/1989 ..... A47B 97/00
(Continued)

OTHER PUBLICATIONS

EP Search Report in European Application No. EP 19194334, dated Jan. 16, 2020, 9 pages.

*Primary Examiner* — Andrew M Roersma
(74) *Attorney, Agent, or Firm* — Fish & Richardson P.C.

(57) ABSTRACT

A refrigerator includes a cabinet that defines a storage chamber, an upper door that is configured to open and close an upper portion of the storage chamber by being drawn in and out, a lower door that is positioned below the upper door and that is configured to open and close a lower portion of the storage chamber by being drawn in and out, an upper door restriction unit that is configured to selectively restrict the upper door from being opened, and a lower door restriction unit that is configured to selectively restrict the lower door from being opened. The upper door restriction unit is configured, based on the lower door being opened, to restrict the upper door from opening, and the lower door restriction unit is configured, based on the upper door being opened, to restrict the lower door from opening.

19 Claims, 28 Drawing Sheets

(51) Int. Cl.

| | |
|---|---|
| ***F25D 29/00*** | (2006.01) |
| ***E05B 65/46*** | (2017.01) |
| ***E05B 65/463*** | (2017.01) |
| *A47B 97/00* | (2006.01) |

(52) U.S. Cl.
CPC ..... *F25D 29/00* (2013.01); *A47B 2097/008* (2013.01); *E05Y 2900/31* (2013.01); *F25D 2323/02* (2013.01); *F25D 2500/02* (2013.01)

(58) Field of Classification Search
CPC ..... E05Y 2900/31; A47B 88/50; A47B 88/70; A47B 2097/008; E05B 65/462; E05B 65/463
See application file for complete search history.

(56) References Cited

U.S. PATENT DOCUMENTS

| | | | | |
|---|---|---|---|---|
| 2018/0128539 | A1* | 5/2018 | Staud | A47B 88/497 |
| 2018/0128540 | A1* | 5/2018 | Yasaka | B66D 1/12 |
| 2018/0259246 | A1* | 9/2018 | Choi | F25D 25/025 |
| 2019/0293345 | A1* | 9/2019 | Kim | F25D 25/025 |
| 2020/0025441 | A1* | 1/2020 | Ji | F25D 25/025 |

FOREIGN PATENT DOCUMENTS

| | | | | |
|---|---|---|---|---|
| DE | 9105559 | U1 * | 9/1991 | E05B 65/462 |
| DE | 29701427 | U1 * | 3/1997 | A61B 12/001 |
| DE | 29620152 | | 4/1997 | |
| GB | 2108564 | | 5/1983 | |
| JP | 2001052474 | A * | 2/2001 | E05B 65/463 |
| KR | 10-2006-0053420 | | 5/2006 | |
| KR | 10-2008-0101335 | | 11/2008 | |

* cited by examiner

REFRIGERATOR

CROSS REFERENCE TO RELATED APPLICATION

The present application claims priority to Korean Patent Application No. 10-2018-0102975, filed on Aug. 30, 2018, the entire contents of which is incorporated herein for all purposes by this reference.

TECHNICAL FIELD

The present disclosure relates to a refrigerator.

BACKGROUND

In general, refrigerators are home appliances for storing foods at a low temperature in a storage chamber that is covered by a door. Generally, refrigerators cool the inside of the storage chamber by using cool air generated by being heat-exchanged with a refrigerant circulated through a refrigeration cycle to store foods in an optimum state.

In recent years, refrigerators have become increasingly multi-functional with changes of dietary lives and diversification of products, and, accordingly, refrigerators having various structures and convenience devices for convenience of users and for efficient use of internal spaces have been released.

The storage chamber of the refrigerator may be opened/closed by the door. Also, refrigerators may be classified into various types according to an arranged configuration of the storage chamber and a structure of the door for opening and closing the storage chamber.

The refrigerator door may be classified into a rotation-type door that opens and closes a storage chamber through rotation thereof and a drawer door that is inserted and withdrawn in a drawer type.

Also, the drawer door is often disposed in a lower region of the refrigerator. Thus, when the drawer-type door is disposed in the lower region of the refrigerator, a user has to bend his/her back to take out a basket or foods in the drawer door. If the basket or the foods are heavy, the user may find it inconvenient to use the basket and/or may be injured.

SUMMARY

According to one aspect of the subject matter described in this application, a refrigerator includes a cabinet that defines a storage chamber, an upper door that is configured to open and close an upper portion of the storage chamber by being drawn in and out, a lower door that is positioned below the upper door and that is configured to open and close a lower portion of the storage chamber by being drawn in and out, an upper door restriction unit that is configured to selectively restrict the upper door from being opened, and a lower door restriction unit that is configured to selectively restrict the lower door from being opened. The upper door restriction unit is configured, based on the lower door being opened, to restrict the upper door from opening, and the lower door restriction unit is configured, based on the upper door being opened, to restrict the lower door from opening.

Implementations according to this aspect may include one or more of the following features. For example, the refrigerator may further include a partition member disposed inside the storage chamber that divides the upper portion from the lower portion, upper pinions that are disposed at left and right sides of the partition member, and upper draw-out racks that are disposed at a bottom surface of the upper door, the upper draw-out racks being configured to be gear coupled to the upper pinions to thereby move together with the upper pinions. In some cases, the refrigerator may further include a partition member that is disposed between the upper door and the lower door to divide the storage chamber in a vertical direction, the partition member being configured to contact the upper door and the lower door based on each of the upper door and the lower door being in a closed state. The upper door restriction unit and the lower door restriction unit may be provided on the partition member.

In some implementations, the partition member may be extended in a left-right direction across an entire width of a front end portion of the storage chamber, and the upper and lower portions of the storage chamber may be in fluid communication with each other. The upper door restriction unit and the lower door restriction unit may be provided at the partition member and be configured to come in contact with the upper door and the lower door, respectively. In some cases, the upper door restriction unit and the lower door restriction unit may protrude through a top surface and a bottom surface of the partition member, respectively, to selectively restrict the upper door and the lower door. Also, the lower door restriction unit may include a lower restriction unit case that is provided at the partition member and that defines top and bottom openings, a second slider that is accommodated in the lower restriction unit case and configured to move up and down therein, the second slider being exposed through the top and bottom openings of the lower restriction unit case, respectively, and a lower elastic member having each opposing end connected to the restriction unit case and the second slider, respectively, and configured to be tensioned based on the second slider moving downward.

In some implementations, the second slider may include an upper part that extends in the vertical direction and that includes an upper end that is configured to become restricted with the bottom surface of the upper door, and a lower part that extends forward from the lower end of the upper part and that is configured to be selectively restricted with the rear surface of the lower door based on the upper part moving up and down. In some cases, the refrigerator may further include an upper restriction protrusion that is provided at a lower portion of the upper door, the upper restriction protrusion being configured, based on the upper door being closed, to press down a top surface of the upper part of the second slider. In some cases, a rear surface of the upper restriction protrusion may include an inclined part that is inclined toward a rearward direction, an upper end at a front surface of the upper part may include an inclined surface having an inclination corresponding to the inclined part, and the inclined part and the inclined surface may be configured, based on the upper door being drawn in from a drawn-out state, to come into contact with each other to thereby move the second slider downward.

In some implementation, the upper part may define a guide slot that is extended vertically along a longitudinal direction of the upper part, the guide slot being open toward left and right sides of the upper part, and an inner side surface of the lower restriction unit case may include an upper fixing part that extends through the guide slot and to guide a vertical up-down movement of the second slide. The lower elastic member may be accommodated inside the guide slot, and the upper end of the lower elastic member may be fixed to the upper fixing part and the lower end of the lower elastic member is fixed to a lower fixing part provide at the lower end of the guide slot. A cut part through which the upper part passes may be defined at a lower end at a front surface of the lower restriction unit. A lower end of the second slider may include a locking member that protrudes forward, the locking member being configured to be selectively restricted with the lower door by passing in and out of a restriction groove provided at the door rear surface.

In some implementations, the locking member may have a plate shape and be made from a metal material, the locking member being mounted on a bottom surface of the second slider and having a front surface part protruding from the front end of the locking member that is bent upward and configured to be inserted into the restriction groove. In some cases, the locking member may include a bottom surface part that is in contact with the bottom surface of the second slider, and a front surface part that is bent upward from the front end of the lower surface part and is positioned farther forward than a front surface of the second slider. The restriction groove may be recessed on the rear surface of the lower door at a position that corresponds to the front end of the second slider, and may be open downward to be restricted with an end portion of the locking member based on the locking member moving up and down. The storage chamber may include an upper storage chamber that is positioned vertically above the upper and lower portions of the storage chamber, the refrigerator further including a rotation-type door that is configured to rotate to open and close the upper storage chamber.

According to another aspect, a refrigerator includes a cabinet that defines a storage chamber, an upper door that is configured to open and close a portion of the storage chamber by being drawn in and out, a lower door that is positioned below the lower door and that is configured to open and close the other portion of the storage chamber by being drawn in and out, an elevation assembly that is provided in the lower door and configured to elevate a container or a food in the lower door based on the lower door being drawn out, an upper door restriction unit that is provided in the storage chamber and configured to selectively restrict the upper door based on a state of the lower door, and a lower door restriction unit that is provided in the storage chamber and configured to selectively restrict the lower door based on a state of the upper door. The upper door and the lower door are configured to maintain a non-restricted state based on the upper door and the lower door both being closed, and the lower door restriction unit is configured to restrict the lower door based on the upper door being in a drawn-out state, and the upper door restriction unit is configured to restrict the upper door based on the lower door being in a drawn-out state such that the upper door and the lower door are restricted from simultaneously being drawn out.

According to another aspect, a refrigerator includes a cabinet that defines a storage chamber, an upper door that is configured to open and close a portion of the storage chamber by being drawn in and out, a lower door that is positioned below the lower door and that is configured to open and close the other portion of the storage chamber by being drawn in and out, a partition member that is provided in the storage chamber and that is in contact with rear surfaces of the upper door and the lower door in a state in which the upper door and the lower door are closed, and a door restriction unit that is provided on the partition member, that is configured to restrict the lower door based on the upper door being opened, and that is configured to restricts the upper door based on the lower door being opened such that the upper door and the lower door are restricted from being simultaneously opened.

DETAILED DESCRIPTION

Hereinafter, implementations of the present disclosure will be described in detail with reference to the accompanying drawings.

Figure 1:
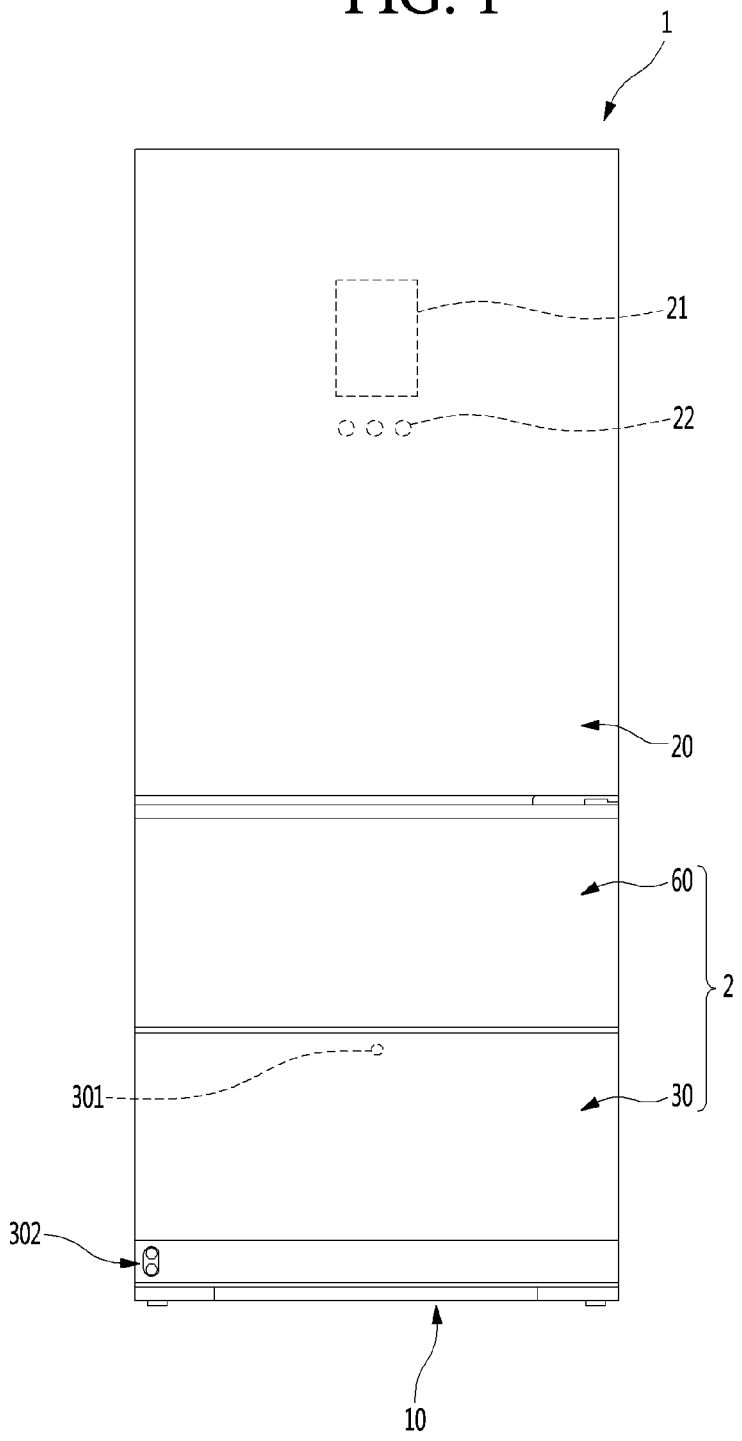
FIG. 1 is a front view of a refrigerator according to an implementation.
Figure 2:
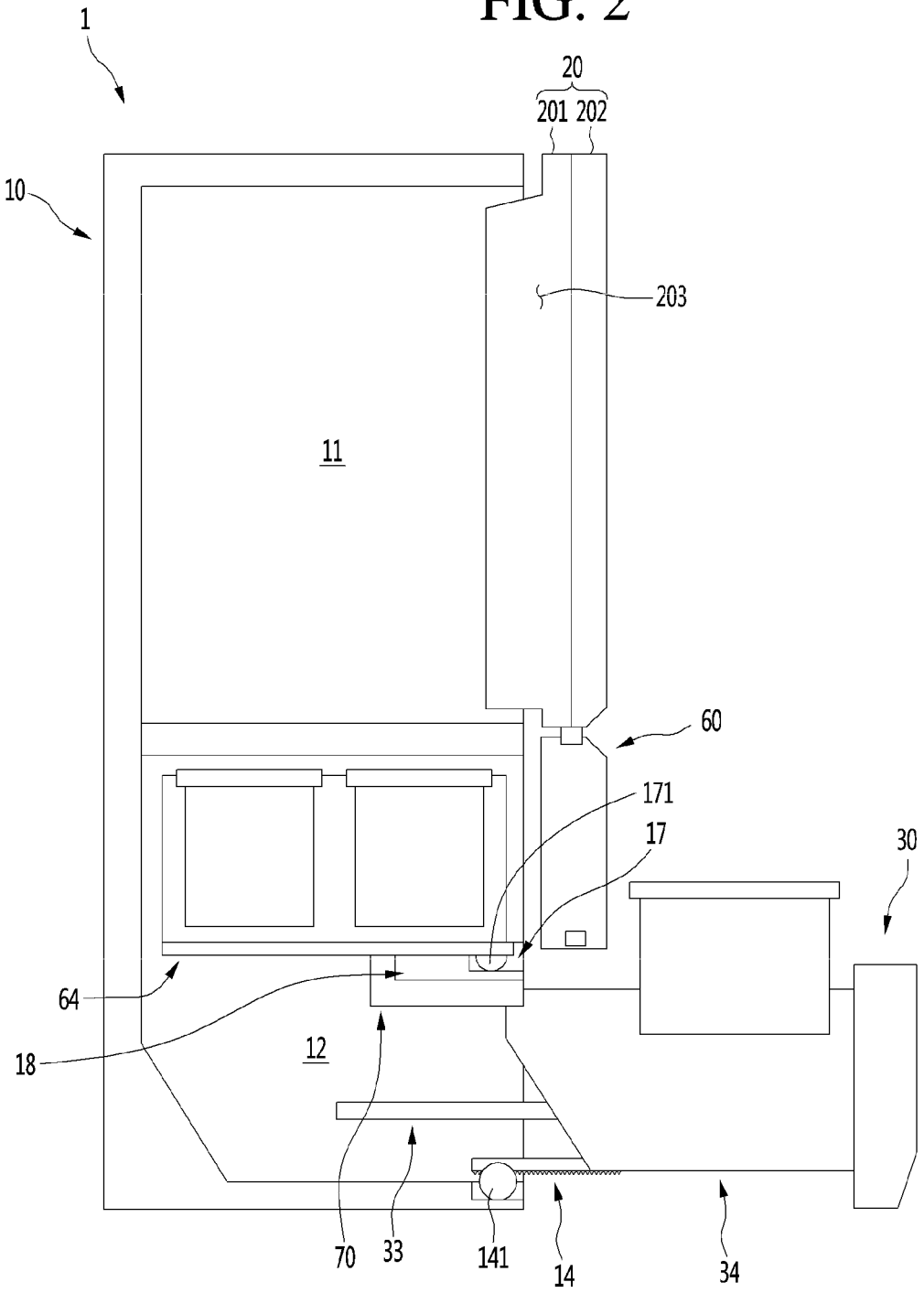
FIG. 2 is a schematic vertical cross-sectional view of the refrigerator.

FIG. 1 is a front view of a refrigerator according to an implementation. Also, FIG. 2 is a schematic cross-sectional view of the refrigerator.

As illustrated in the drawing, the refrigerator 1 may have an outer appearance that is defined by a cabinet 10 defining a storage chamber and a door covering an opened front surface of the cabinet 10.

The storage chamber of the cabinet 10 may be divided into a plurality of spaces. For example, an upper space of the cabinet 10 may be provided as a refrigerating compartment 11, and a lower space (or lower storage chamber) 12 of the cabinet 10 may be provided as a freezing compartment. Each of the upper space and the lower space may be provided as an independent space that is maintained at a different temperature, except for the refrigerating compartment 11 and the freezing compartment 12. The upper space and the lower space may be referred to as an upper storage chamber 11 and a lower storage chamber 12 or a first storage chamber and a second storage chamber.

The door may include a rotation door 20 opening and closing the upper storage chamber 11 through a rotation thereof and a drawer door 2 opening and closing the lower storage chamber 12 by being inserted or withdrawn in a drawer type configuration.

Although the refrigerator in which both the rotation door 20 and the drawer door 2 are provided is described, the present disclosure is not limited thereto. For example, the present disclosure may be applied to all refrigerators including a door that is inserted and withdrawn in the drawer type.

The rotation door 20 may include a main door 201 and a sub door 202. The main door 201 may be rotatably mounted on the cabinet 10 and may include a separate door accommodation space 203 for accommodating the door at an opened center thereof. A plurality of baskets may be provided in the door accommodation space 203. Also, the sub door 202 may cover an opened front surface of the main door 201. Thus, a user may allow the main door 201 to rotate and thereby open and close the upper storage chamber 11 and allow the sub door 202 to rotate and thereby open and close the door accommodation space 203.

A display 21 may be disposed on one side of a front surface of the rotation door 20. The display 21 may have a liquid crystal display structure or a "88" type segment structure. Also, when the outer appearance of the door is made of the metal material, a plurality of fine holes may be punched in the display 21 to display information by using light passing therethrough.

Also, a manipulation part 22 that is capable of manipulating automatic rotation or withdrawal of the rotation door 20 or the drawer door 2 may be provided on one side of the rotation door 20. The manipulation part 22 may be integrated with the display 21 and may operate in a touch manner or a button manner. The manipulation part 22 may be used to input an overall operation of the refrigerator 1 and manipulate an insertion and withdrawal of the drawer door 2 or an elevation of an elevation member 35 within the drawer door 2.

The drawer door 2 may be provided in the lower storage chamber 12 and have a structure like a drawer which is capable of being inserted and withdrawn in a front and rear direction. In a state in which the drawer door 2 is withdrawn, the accommodation space that is opened upward may be exposed. Also, a portion of the drawer door 2 may be elevated in the drawn-out state, and thus, the food container accommodated in the drawer door 2 may move upward to allow the user to easily lift the food container.

The lower storage chamber 12 may also be vertically partitioned by the partition member 18. The partition member 18 may extend from a left end to a right end of the lower storage chamber and may have a predetermined width and thickness. Also, the partition member 18 may divide the whole or a portion of the lower storage chamber and may be provided only in a portion of the front part so that the partition member 18 contacts the drawer door 2 to seal the drawer door 2.

An upper door 60 and a lower door 30 with respect to the partition member 18 may be provided in the lower storage chamber. The upper door 60 and the lower door 30 may be withdrawn forward and opened, and the partition member 18 may be provided between the upper drawer door 60 and the lower drawer door 30 and may be configured to be in contact with the upper door 60 and the lower door 30 in a state in which the upper door 60 and the lower door 30 are closed.

One or both of the lower door 30 and the upper door 60 may be automatically elevated based on user's manipulation. For example, a manipulation part 301 may be provided on the lower drawer door 30. The manipulation part 301 may be provided as a touch or button type. In some cases, the manipulation part 301 may be provided as a sensor detecting proximity or movement of a user or provided as an input unit that operates by a user's motion or voice.

As illustrated in the drawings, a manipulation device 302 may be disposed on a lower end of the lower door 30 to illuminate an image on a bottom surface and thereby to output a virtual switch and to input an operation when the user approaches a corresponding area.

A draw-out motor 14 may be provided on the bottom surface of the lower storage chamber 12. A draw-out rack 34 coupled to a pinion 141 rotating by the draw-out motor 14 may be provided on the bottom surface of the lower door 30. Thus, the lower door 30 may be automatically inserted and withdrawn according to the manipulation of the manipulation part 301. Also, a food or container within the lower door 30 may be elevated in a state in which the lower door 30 is withdrawn by the manipulation of the manipulation part 301.

That is, the automatic insertion and withdrawal and/or automatic elevation of the lower door 30 may be performed by at least one of a plurality of manipulation devices 22, 301, and 302. One or more of the plurality of manipulation devices 22, 301, and 302 may be provided as needed.

The lower door 30 may automatically operate continuously in conjunction with the insertion/withdrawal and the elevation thereof or may be configured such that the insertion/withdrawal and elevation operations may respectively operate by the user's manipulation.

Also, the upper door 60 may also be automatically inserted/withdrawn and/or elevated. For instance, an upper draw-out motor 17 may be provided inside the partition member 18, and an upper draw-out rack 64 coupled to the upper pinion 171 may be provided on the bottom surface of the upper door 60.

Hereinafter, the lower door 30 will be described in more detail. The upper door 60 may have the same structure as the lower drawer door 30 and/or the same elevation structure as the lower drawer door 30.

Figure 3:
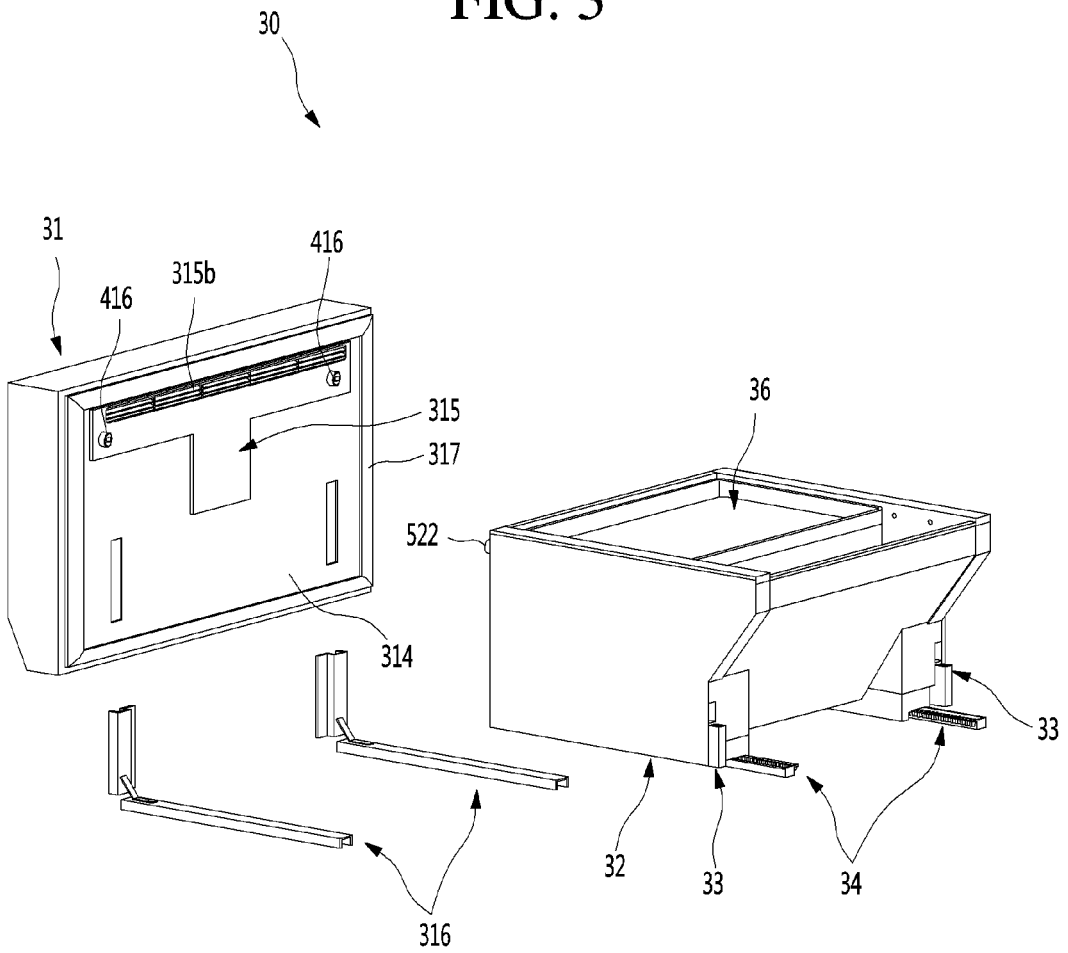
FIG. 3 is an exploded perspective view of a drawer door according to an implementation.
Figure 4:
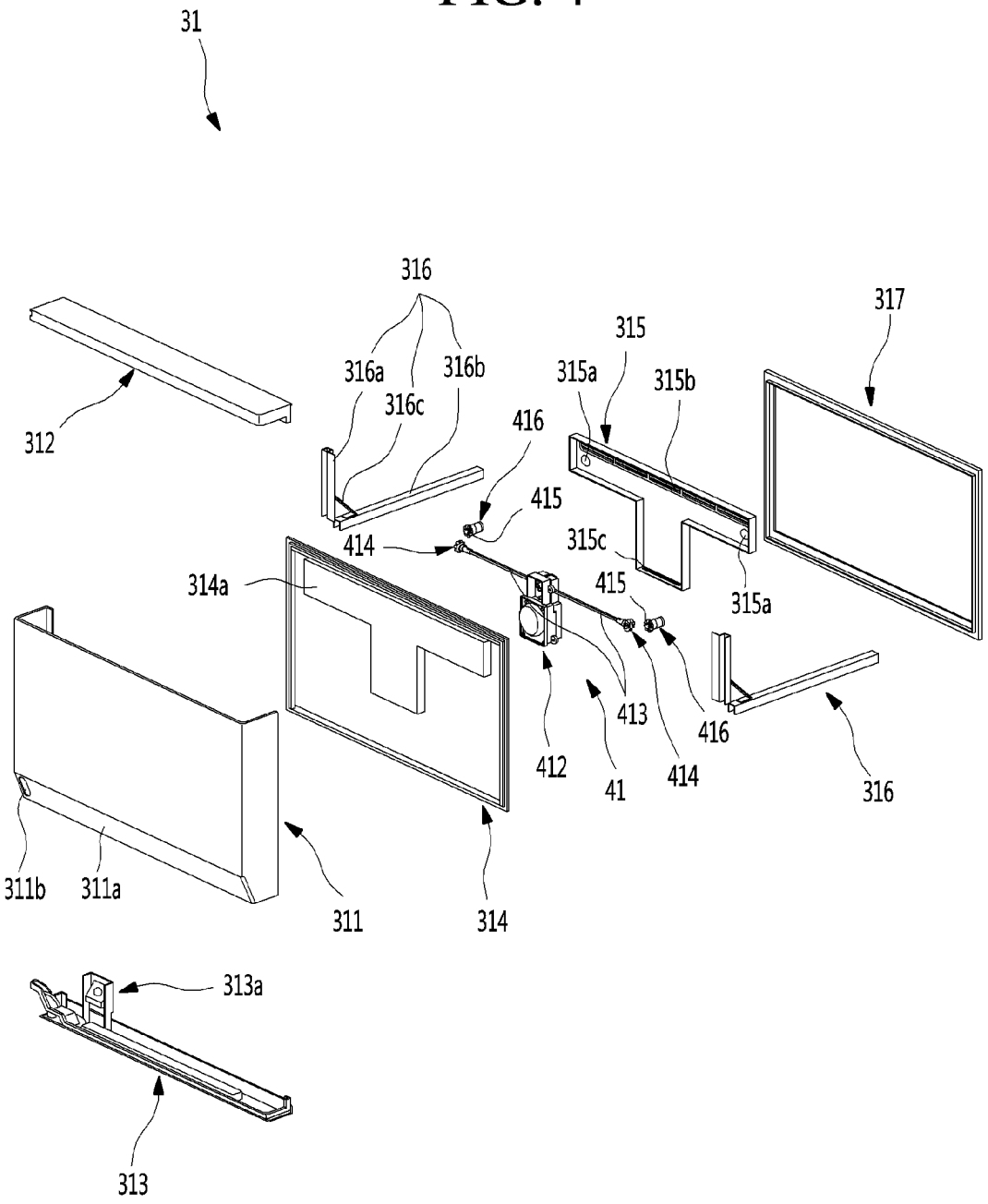
FIG. 4 is an exploded perspective view of a door part of the drawer door.

FIG. 3 is an exploded perspective view of a drawer door according to an implementation.

As illustrated in the drawings, the lower door 30 may include a door part 31 for opening and closing the storage chamber and a drawer part 32 coupled to a rear surface of the door part 31 and inserted and withdrawn together with the door part 31.

The door part 31 may be exposed to the outside of the cabinet 10 to define an outer appearance of the refrigerator 1, and the drawer part 32 may be disposed inside the cabinet 10 to define an storage chamber. Also, the door part 31 and the drawer part 32 may be coupled to each other and inserted and withdrawn in a forward/backward direction together with each other.

The drawer part 32 may be disposed on the rear surface of the door part 31 to define a space in which the food or container to be stored is accommodated. The inside of the drawer part 32 may have an accommodation space that is opened upward.

In the state in which the lower door 30 is inserted, a machine room 3 in which a compressor and a condenser for performing a refrigeration cycle are provided may be disposed behind the lower door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the lower door 30 may be provided on each of both side surfaces of the drawer part 32. The lower door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided on the bottom surface of the drawer part 32 and called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the lower door 30. That is, when the manipulation parts 22 and 301 are manipulated to be inputted, the draw-out motor 14 may be driven to be inserted and withdrawn. Accordingly, the drawer door 2 may be more stably inserted and withdrawn by the draw-out rail 33.

In some implementations, the draw-out rack 34 may not be provided on the drawer part 32. Here, the user may hold a side of the door part 31 to push and pull the door part so that the lower door 30 is directly inserted and withdrawn.

The inside of the drawer part 32 may be divided into a front space S1 and a rear space S2. The elevation member 35 that is vertically elevated and a container seated on the elevation member 35 to be elevated together with the elevation member 35 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

In some cases, when the lower door 30 is withdrawn, the entire drawer part 32 may not be withdrawn to the outside of the storage chamber due to a limitation in draw-out distance of the lower door 30. That is, at least the front space S1 is withdrawn to the outside of the storage chamber, and the whole or a portion of the rear space S2 is remains inside the storage chamber within the cabinet 10.

In such a structure, the draw-out distance of the lower door 30 may be limited by the draw-out rack 34 or the draw-out rail 33. As the draw-out distance becomes longer, the moment applied to the lower door 30 may become larger in the drawn-out state, and thus it may be difficult to maintain a stable state, thus resulting in possible deformation or damage of the draw-out rail 33 or the draw-out rack 34 may occur.

An elevation member 35 may be accommodated in the front space S1 so that the food or the container 36 seated on the elevation member 35 can be elevated together with the elevation member 35. Also, drawer-side device 50 for the elevation of the elevation member 35 may be disposed on both left and right surfaces of the drawer part 32 and be elevated at a center of each of both side surfaces of the elevation member 35.

A separate drawer cover 37 may be provided in the rear space S2. The front space S1 and the rear space S2 may be partitioned by the drawer cover 37. In a state in which the drawer cover 37 is mounted, front and top surfaces of the rear space S2 may be covered and may not be used. However, when the drawer cover 37 is separated, the user may be accessible to the rear space S2, and thus, foods may be easily accommodated in the rear space S2. To utilize the rear space S2, a separate pocket or a container corresponding to the shape of the rear space may be disposed in the rear space S2.

The door part 31 and the drawer part 32 of the lower door 30 may be separably coupled to each other. Thus, assembling workability and serviceability may be improved through the separable structure of the door part 31 and the drawer part 32.

A rear surface of the door part 31 and a front surface of the drawer part 32 may be coupled to each other. When the door part 31 and the drawer part 32 are coupled to each other, power for the elevation of the elevation member 35 may be provided. The elevation assembly 40 for the elevation of the elevation member 35 may be disposed on each of the door part 31 and the drawer part 32. When the door part 31 and the drawer 32 are coupled to or separated from each other, the elevation assembly may be selectively connected.

For this, the elevation assembly 40 may include the door-side device 41 disposed in the door part 31 and the drawer-side device 50 disposed in the drawer part 32. The door-side device 41 may be provided in the door part 31, and a door connection member 416 that is one component of the door-side device 41 may be exposed to the rear surface of the door part 31. Also, the drawer-side device 50 may be provided in the drawer part 32, and a drawer connection member 522 disposed at a position corresponding to the door connection member 416 may be exposed to the front surface of the drawer part 32. The door connection member 416 and the drawer connection member 522 may have shapes corresponding to each other and be coupled to be separated from each other. When the door connection member 46 and the drawer connection member 522 are coupled to each other, power may be transmitted. When the door part 31 is fixed to the drawer part 32, the door connection member 416 and the drawer connection member 522 may be coupled to each other. When the door part 31 is separated from the drawer part 32, the door connection member 416 and the drawer connection member 522 may be separated from each other.

In some implementations, an elevation motor 411 serving as a power source of the elevation assembly 40 may be provided in the door part 31. Also, a door cover 315 may be disposed above a space in which the elevation motor 411 is provided. The door cover 315 may be disposed on the rear surface of the door part 31 to cover the door-side device 41 including to the elevation motor 411 provided in the door part 31.

In more detail, the door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, the inside of the door part 31 may be filled with a heat insulating material and may provide a space in which the door-side device 41 of the elevation assembly 40 is mounted.

The outer case 311 may be formed by bending a plate-shaped metal material, and an inclined part 311*a* may be provided on a lower end of a front surface of the outer case 311. A manipulation device hole 311*b* may be defined in one side of the inclined part 311*a*, and the manipulation device 302 for detecting an output of a virtual switch and user's manipulation may be mounted in the manipulation device hole 311*b*. The manipulation device 302 may include a projector light that outputs an image and a proximity sensor. Also, a manipulation part bracket 313*a* for the mounting of the manipulation device 302 and an arrangement of a line connected to electrical components within the door part 31 may be provided in the lower deco 313.

The door liner 314 may be made of a plastic material, and a recess part 314*a* that is recessed toward the outer case 311 may be provided so that the door-side device 41, including the elevation motor 411, may be mounted therein. The door cover 315 may be mounted on the door liner 314 to cover the door-side device mounted on the door part 31 and the recess part 314*a*.

A connection member hole 315*a* may be defined in the rear surface of the door part 31. The connection member hole 315*a* may be defined in the door cover 315. The door connection member 416 may be exposed to the rear surface of the door part 31 through the connection member hole 315*a*. The door connection member 416 may move forward and backward according to the user's manipulation. When the door part 31 and the drawer part 32 are separated from each other by the user's manipulation, the door connection member 416 and the drawer connection member 522 may be separated from each other.

The door-side device 41 may be provided on the door part 31. The door-side device 41 may be disposed on the door part 31 of the elevation assembly and include a motor assembly 412 that includes the elevation motor 411 and gears, a door-side shaft rotating by the motor assembly 412, a door-side first gear 414 having a bevel gear shape and disposed on each of both ends of the door-side shaft 413, and a door-side second gear 415 having a bevel gear shape and coupled to the door-side first gear 414 and the door connection member 416. A configuration of each of the elements of the door-side device 41 will be described below in more detail.

The motor assembly 412 may provide power for elevating the elevation member 35 and be disposed in parallel to the front surface of the door part 31 to minimize the recessed space inside the door part 31. Also, the door-side shaft 413 connected to both sides of the motor assembly 412 is connected to the elevation motor 411 to rotate at the same time.

The pair of door frames 315 may be disposed on both left and right sides on the rear surface of the door part 31. The door frames 316 may connect the door part 31 to the drawer part 32 so that the drawer part 32 is maintained in the state of being coupled to the door part 31. Also, a gasket 317 contacting the front end of the cabinet 10 to seal the storage chamber may be disposed around the rear surface of the door liner 314. In some implementations, the door frame 316 may include a vertical portion 316*a*, a horizontal portion 316*b*, and a support portion 316*c* that provides structural support between the vertical and horizontal portions.

Figure 5:
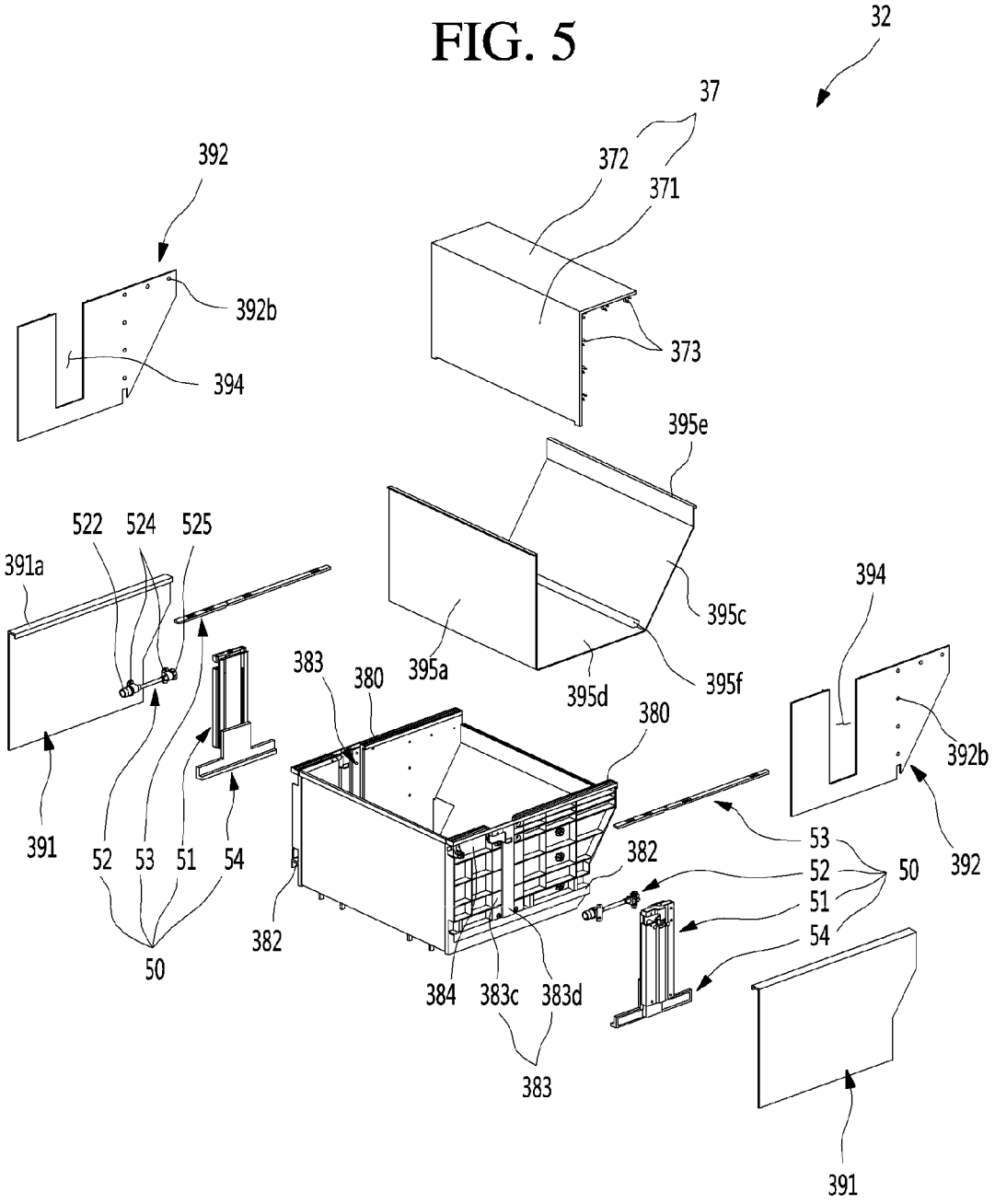
FIG. 5 is an exploded perspective view of a drawer part of the drawer door.

FIG. 5 is an exploded perspective view of the drawer part of the drawer door.

As illustrated in the drawings, the drawer part 32 may include a drawer body 38 defining an entire shape of the drawer part 32, a drawer-side device 50 provided in the drawer body 38 to provide the elevation assembly 40, and a plurality of plates 391, 392, and 393 defining an outer appearance of the drawer part 32.

In some implementations, the drawer body 38 may be injection-molded by using a plastic material and define an entire shape of the drawer part 32. Also, the inner and outer appearances of the drawer part 32 may be defined by the plurality of plates 391, 392, and 395. The drawer body 38 may have a basket shape having an opened top surface to define a food storage chamber therein.

The draw-out rack 34 may be disposed on each of both the sides of the bottom surface of the drawer part 32. The drawer part 32 may be inserted and withdrawn forward and backward by the draw-out rack 34. In some cases, in the state in which the drawer part 32 is mounted on the cabinet 10, at least a portion may be disposed in the storage chamber. Also, the draw-out rack 34 may be coupled to a pinion gear 141 disposed on the bottom surface of the storage chamber. Thus, when the draw-out motor 14 is driven, the pinion gear 141 may rotate to allow the draw-out rack 34 to move, and the lower drawer door 30 may be inserted and withdrawn.

A plurality of reinforcement ribs 381 may extend in vertical and horizontal directions on both left and right sides of the drawer body 38. The reinforcement ribs 381 may prevent the drawer body 38 from being deformed by a load applied to both the left and right surfaces of the drawer body.

Particularly, the rail assembly 51, which is a main component for the elevation of the elevation member 35, may be disposed on both side surfaces of the drawer body 38. Thus, when the elevation member 35 and the food or container seated on the elevation member 35 is elevated, a load may be concentrated into both the side surfaces of the drawer body 38. The reinforcement ribs 381 may maintain the shape of the drawer body 38, particularly, the drawer part 32 even under the concentrated load.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a rail that extends in multistage. The draw-out rail 33 may have one end fixed to the storage chamber inside the cabinet 10 and the other end fixed to the rail mounting part 382 to more stably realize insertion and the withdrawal of the lower drawer door 30. The rail mounting part 382 may be disposed in an inner region of the drawer flange 380, which will be described below, and may be covered by the outer side plate 391.

A mounting part 383 on which the rail assembly 51 that is a main component is mounted may be recessed inside both the side surfaces of the drawer body 38. The mounting part 383 may be recessed outward from the inner surface of the drawer body 38 providing the drawer space.

The mounting part 383 may extend in the vertical direction. Here, the mounting part 383 may vertically extend from the upper end of the drawer body 38 to the bottom surface of the drawer body 38. Here, a lower end of the mounting part 383 may be disposed above a lower end of each of both the side surfaces of the drawer body 38. The lower end of the mounting part 383 may extend up to the rail mounting part 382. Thus, the mounting part 382 may not interfere with the draw-out rail 33 and its mounting components.

Also, the inner surface of the mounting part 383 may have a shape corresponding to that of the outer surface of the rail assembly 51. Here, in the even state in which the load is applied, the stably mounted state of the rail assembly 51 may be maintained.

In more detail, the mounting part 383 may be stepped to correspond to the outer side surface of the rail assembly 51, and the mounting part 383 may be restricted without rotating in a state in which the rail assembly 51 having corresponding shape is mounted. Also, the rail assembly 51 may be disposed on the same plane as the inner surface of the drawer body 38 in the state of being mounted on the mounting part 383 to prevent the interference when the elevation member 35 is elevated and provide a sense of unity.

A mounting part bracket 53 may be disposed on the opened top surface of the mounting part 383. The mounting part bracket 53 may be made of a metal material and restrict the upper end of the rail assembly 51.

The rail assembly 51 may be connected to both ends of the elevation member 35 by the connecting bracket 54. Also, the rail assembly 51 may operate to allow the elevation member 35 to vertically move and guide smooth vertical movement of the elevation member 35.

The shaft mounting part 384 may be opened outward from the upper end of each of both the side surfaces of the drawer body 38 to communicate with the mounting part 383. Thus, the drawer-side shaft 52 mounted on the shaft mounting part 384 may be coupled to the rail assembly 51 mounted on the mounting part 383 to transmit the power.

The mounting part 383 and the shaft mounting part 384 may be disposed inside a region of the drawer flange 380 that is bent outward from an upper end of each of both side surfaces of the drawer body 38. That is, the mounting part 383 and the shaft mounting part 384 may be disposed below the region in which the drawer flange 380 is bent outward. Also, in addition to the mounting part 383 and the shaft mounting part 384, the rail assembly 51 and the drawer-side shaft 52, which are mounted on the mounting part 383 and the shaft mounting part 384, may not also protrude inward or outward from the drawer flange 380. Components of the drawer-side device 50 that make up a portion of the elevation assembly 40 and the structure for mounting the drawer-side device 50 may be disposed in the region of the drawer flange 380. Thus, a loss of the storage chamber inside the drawer body 38 may be prevented from occurring. Also, the reinforcement rib 381 and the rail mounting part 382 may also be disposed inside the region of the drawer flange 380.

The outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, elements such as the drawer-side shaft 52 and the draw-out rail 33, which are mounted on both the sides of the drawer body 38, may not be exposed to the outside.

Also, an upper bent part 391*a* may be disposed on an upper end of the outer side plate 391. The upper bent part 391*a* may cover the upper end of each of both the side surfaces of the drawer body 38 and the mounting part bracket 53.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

An extending end of the upper bent part 391*a* may contact the upper end of the inner side plate 391. Thus, all of the inside and outside and the top surface of both the left and right surfaces of the drawer body 38 may be covered by the inner side plate 392 and the outer side plate 391.

Also, a side opening 394 having a size corresponding to the mounting part 383 may be defined in the inner side plate 392. Thus, in the state in which the inner side plate is mounted, the rail assembly 51 mounted on the mounting part 383 may be exposed to the inside of the drawer body 38, and since the connecting bracket 54 is mounted, the rail assembly 51 may be coupled to the elevation member 35.

An inner plate 395 may be disposed on each of front, bottom, and rear surfaces of the inside of the drawer body 38. The inner plate 395 may include a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* of the inner plate 395 may be separately provided and then coupled to or contact each other.

In some implementations the entire inner surfaces of the drawer body 38 may be defined by the inner side plate 392 and the inner plate 395, and the inner surface of the drawer body 38 may provide a texture of a metal surface. Thus, the storage chamber within the drawer part 32 may have a metallic texture on the whole, and the foods accommodated in the drawer part 32 may be more uniformly cooled and thus stored at a low temperature in a more uniform region. In addition, excellent cooling and storage performance that is also visually appealing may be provided to the user as a result.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the elevation member 35 is disposed, may be exposed in the drawer body 38, and the rear space S2 may be covered by the drawer cover 37.

The elevation member 35 may be disposed in the drawer body 38. The elevation member 35 may include one component of the elevation assembly 40. The elevation member 35 may have a size that is enough to be accommodated in the front space S1 of the bottom surface of the drawer body 38.

Hereinafter, a structure of the elevation assembly will be described in more detail with reference to the accompanying drawings.

Figure 6:
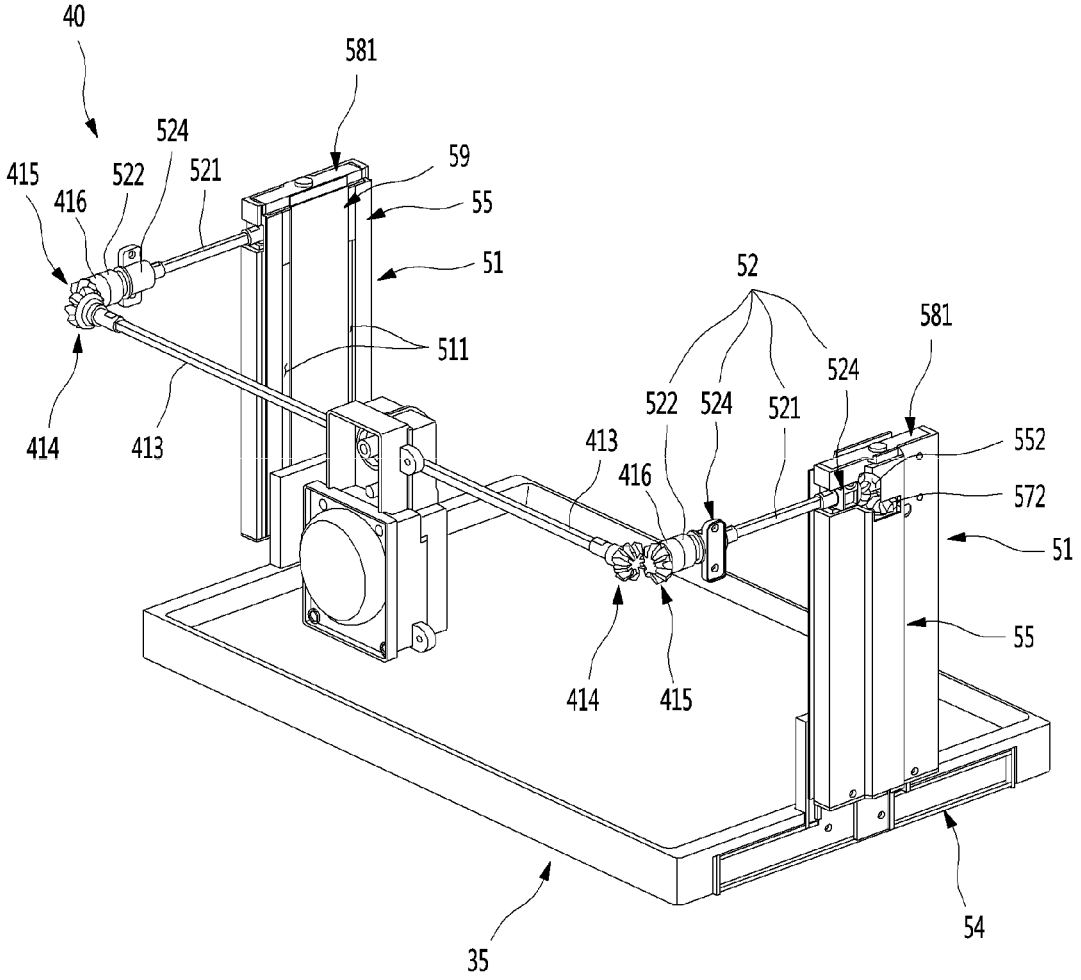
FIG. 6 is a perspective view of an elevation assembly built in the drawer door.
Figure 7:
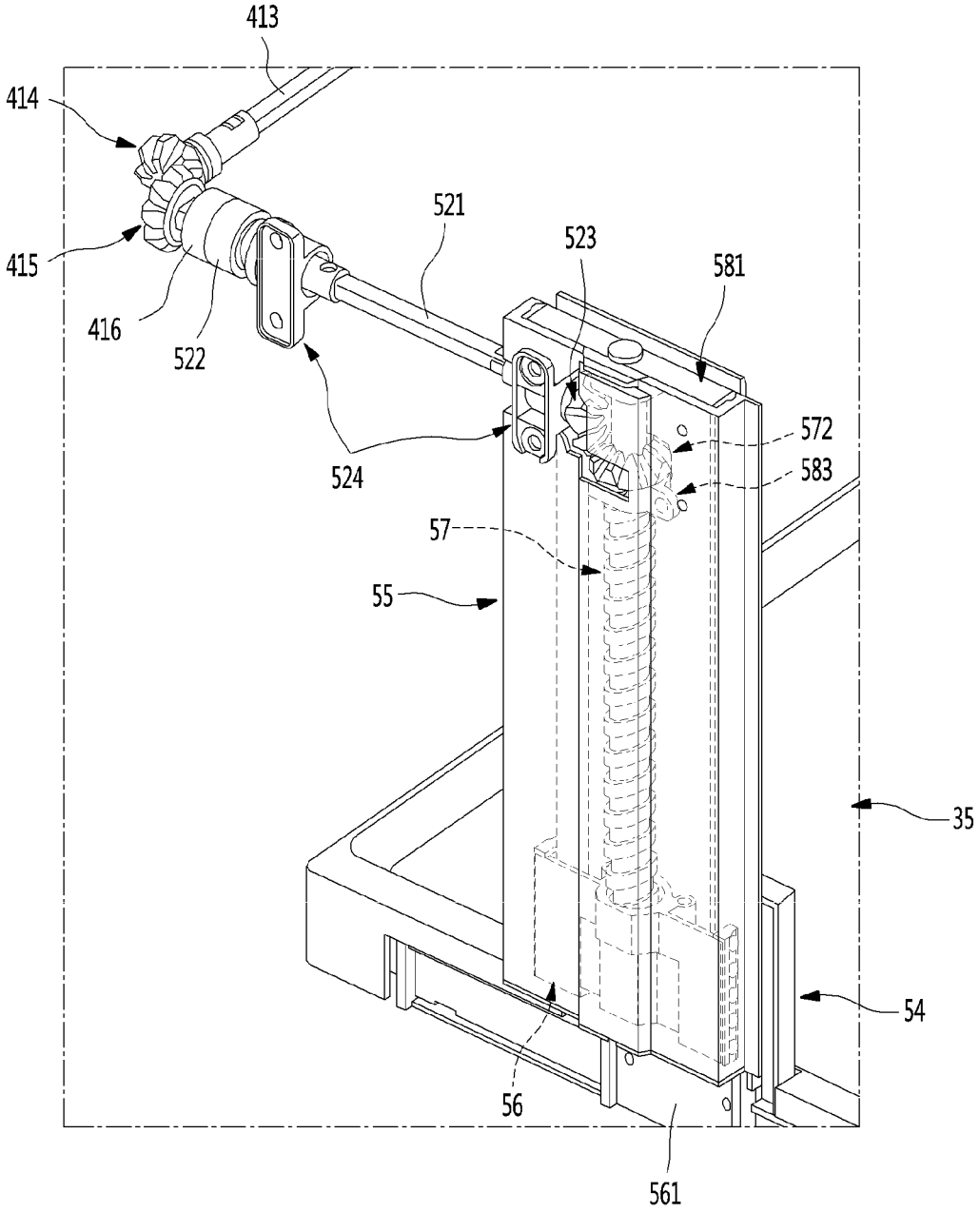
FIG. 7 is a view illustrating a power transmission state of a drawer-side device of the elevation assembly.

FIG. 6 is a perspective view of an elevation assembly built in the drawer door. Also, FIG. 7 is a view illustrating a power transmission state of the drawer-side device of the elevation assembly.

As illustrated in the drawing, the elevation assembly 40 may include the door-side device disposed in the door part 31 and the drawer-side device 50 disposed in the drawer part 32. Also, the door-side device 41 and the drawer-side device 50 may be coupled to each other by coupling the door part 31 to the drawer part 32 to transmit the power.

As described above, the door-side device 41 may include the motor assembly 412 including the elevation motor 411, the door-side shaft 413 coupled to the motor assembly 412 to rotate, the door-side first gear 414 disposed on each of both the ends of the door-side shaft 413, the door-side second gear 415 engaged with the door-side first gear 414, and the door connection member 416 coupled to the door-side second gear 415.

Since the pair of rail assemblies 51 are driven by rotation force transmitted to the pair of door-side second gears 415, the door-side first gear 414 and the door-side second gear 415 may rotate at the same rotation rate and at the same time to prevent the elevation member 35 from being tilted. For this, the door-side shaft 413 may have a structure in which one shaft or a plurality of shafts passing through the motor assembly 412 rotates together with each other.

The door-side shaft 413 extending to each of both sides may rotate at the same time and at the same rotation number according to the driving of the elevation motor 411. Also, the door-side first gear 414 at the end of the door-side shaft 413 may be gear-coupled in a state of perpendicularly crossing the door-side second gear 415 and be in a state in which power transmission is possible. Thus, the door-side second gear 415 rotating by the door-side first gear 414 may allow the door connection member 416 to rotate, and the drawer connection member 416 coupled to the door connection member 522 may rotate together to transmit the rotation force to the drawer-side device 50.

As a result, the door-side device 41 may be connected to the drawer-side device 50 by the coupling of the door part 31 and the drawer part 32, and the one elevation motor 411 provided in the door part 31 may drive components of the drawer-side device 50, which are provided on both sides of the drawer part 32.

The elevation member 35 may have a rectangular plate shape. Substantially, the elevation member 35 may include an elevation plate 351 supporting the food or container and an elevation frame 352 supporting the elevation plate 351 at a lower side and reinforcing strength of the elevation plate 351. The elevation member 35 may be a portion on which the food or container 36 is substantially seated and supported and thus may be referred to as a seating member or a tray.

The connecting bracket 54 may have one side fixed to the elevation frame 352 and the other side coupled to the rail assembly 51 Thus, when the rail assembly 51 operates, the elevation frame 352 connected to the connecting bracket 54, i.e., the support member 35 may vertically move together with the connecting bracket 54.

The drawer-side device 50 disposed in the drawer body 38 of the elevation assembly 40 may be mounted in the drawer body 38. The drawer-side device 50 may include the elevation member 35, the rail assembly 51 disposed on each of both the sides of the elevation member 35 and mounted inside the mounting part 383, the connecting bracket 54, the drawer-side shaft 52, and the mounting part bracket 53 restricting the rail assembly 51.

When the motor assembly 412 is driven, the rotation force of the door-side shaft 413 may be transmitted to the drawer-side device 50 by the door connection member 416 and the drawer connection member 522, which are coupled to each other. When the drawer-side shaft 52 rotates by the rotation of the drawer connection member 522, the elevation shaft 57 inside the rail assembly 51 coupled to the drawer-side shaft 52 rotates.

A block holder coupled to the elevation shaft 57 may vertically move through the rotation of the elevation shaft 57. The block holder 56 may be coupled to the connecting bracket 54 to elevate the connecting bracket 5, and the connecting bracket 54 disposed each of both the left and right sides may elevate the elevation member 35 in the state of being coupled to the elevation frame 352.

That is, the rotation force of the motor assembly 412 may be transmitted to the drawer-side shaft 52 through the door-side shaft 413 to allow the elevation shaft 57 to rotate. The block holder 56 and the connecting bracket 54 may guide the elevation member 35 to move vertically.

The components of the drawer-side device 50 may include the drawer-side shaft 52 having the rail assembly 51 for the vertical movement of the elevation member 35, the drawer-side shaft 52 connected to the rail assembly 51 and the door-side device 41 to transmit the power, and the connecting bracket 54 connected to the rail assembly 51 and the elevation member 35.

The arranged position of the rail assembly 51 may be a position corresponding to a center of the front space S1 in the front and rear direction and be disposed at a position corresponding to a central portion of each of both the side surfaces of the elevation member 35. Thus, the elevation member 35 may be stably elevated without being tilted.

The rail assembly 51 may include the rail housing 55 mounted on the mounting part 383 to define the inner space, the upper and lower caps 581 and 585 covering the upper and lower ends of the housing 55 and the block holder 56, which move along the elevation shaft 57 within the housing 55, and the rail cover 59 covering the opened one surface of the housing 55.

The rail housing 55 and the rail cover 59 may include a pair of guide slits 511 extending in the vertical direction. The elevation block 567 and the block holder 56 may be elevated along the pair of guide slits 511.

Also, the rail housing 55 may be made of a plate-shaped metal material and have a protruding central portion. Here, both side ends of the central portion may extend to be stepped. Also, the rail housing 55 may provide a space in which the elevation shaft 57 and the block holder 56 are accommodated.

Particularly, an inner space of the rail housing 55 may provide a space in which both ends of the block holder 56 are accommodated, and a central portion of the block holder 56 may protrude through a housing opening 551 that is opened in the rail housing 55. Also, the block holder 56 may move along the housing opening 551.

A shaft insertion hole 552 into which an end of the drawer-side shaft 52 extending to the rail assembly 51 is accommodated may be defined in the upper end of the rail housing 55. The shaft insertion hole 552 may be opened in a shape corresponding so that the end of the drawer shaft 521 and the drawer-side gear 523 are inserted, i.e., may be opened to be exposed up to a portion of the elevation shaft 57 coupled to the upper end of the elevation shaft 57. Thus, the drawer-side shaft 52 may be mounted through the shaft insertion hole 552, and also, the coupled state between the drawer-side gear 523 and the shaft gear 572 may be confirmed.

The elevation shaft 57 may be accommodated in the rail housing 55 and disposed at the central portion 553. Also, a screw thread 4571 may be provided on an outer circumferential surface of the elevation shaft 57 so that the elevation block 567 vertically moves along the elevation shaft 57 when the elevation shaft 57 rotates.

The elevation shaft 57 may vertically extend inside the rail housing 55, and upper and lower ends of the elevation shaft 57 may be rotatably supported inside the rail housing 55. Also, the screw thread 571 may be disposed between the upper and lower ends of the elevation shaft 57.

Also, a shaft gear 572 may be disposed on an upper portion of the elevation shaft 57, i.e., an upper end of the screw thread 571. The shaft gear 572 may be disposed on an upper end of the screw thread 571 and be integrally coupled to the elevation shaft 57 to rotate together with the elevation shaft 57. Also, the shaft gear 572 may be gear-coupled to the drawer-side shaft 52 in the state of perpendicularly crossing the drawer-side gear 523 mounted on the drawer-side shaft 52.

The block holder 56 may pass through the central portion of the shaft gear 572. The shaft gear 572 may have a shape corresponding to the inner space of the rail housing 55 so as to be guided vertically move along the rail housing 55 when the elevation shaft 57 rotates.

The outer shape of the block holder 56 may correspond to the inner shape of the rail housing 55. Particularly, the central portion of the block holder 56 may protrude and be inserted into the central portion of the rail housing 55. Both side surfaces of the block holder 56 may protrude laterally and be accommodated in both inner side surfaces of the rail housing 55. Also, the inner surface of the block holder 56 may protrude through the housing opening 551 and be exposed to the inside of the drawer part 32 so as to be coupled to the elevation member 35 or the connecting bracket 54.

As described above, the outer shape of the block holder 56 and the inner shape of the rail housing 55 corresponding to the outer shape of the block holder 56 may be formed in multistage or in a stepped shape. When the elevation member 35 is elevated, it may be possible to effectively distribute and support the load applied to the rail assembly 51 in the left and right direction or the forward and backward direction, thereby realizing the stable elevation.

Also, a rolling member 568 having a plurality of ball bearings arranged in the vertical direction may be provided on both sides of the block holder 56. The rolling member 568 may be disposed between both side surfaces of the block holder 56 and the inner surface of the rail assembly 51 to smoothly elevate the block holder 56.

That is, the block holder 56 may move upward and downward by the rotation of the elevation shaft 57, and the block holder 56 may be connected to the elevation member to provide power for the elevation of the elevation member 35. Simultaneously, the rail assembly 51 may be configured such that the block holder 56 having a multistage shape is guided along the rail assembly 51 from the inside of the rail assembly 51 to guide the vertical movement of the elevation member 35.

A hollow space may be defined in the inside of the block holder 56, and the rail cover 59 may be accommodated in the inside of the block holder 56. Also, the block holder 56 may vertically move along the guide slit 511 defined by the rail cover 59 and the rail housing 55.

The rail cover 59 may cover the housing opening 551 and define the guide slit 511. In some cases, the rail cover 59 may be made of a plate-shaped metal material like the inner side plate 392.

The rail cover 59 may cover the housing opening 551 to cover the components accommodated in the rail housing 55. For this, the rail cover 59 may be disposed in the housing opening 551. Each of both ends of the rail cover may be bent to the inside of the rail housing 55 and then bent outward to form the guide slit 511. Also, the block holder 56 may vertically move along the guide slit 511.

The rail cover 59 may have a cross-sectional shape corresponding to the hollow shape within the block holder 56 to pass through the hollow of the block holder 56. Thus, the block holder 56 may vertically move in a state of being penetrated by the rail cover 59.

Also, the rail cover 59 exposed to the inside of the housing opening 551 may have a horizontal width less than that of the housing opening 551. That is, the guide slit 511 that vertically extends may be defined when the rail cover 59 is mounted.

Also, a distance between both ends of the rail cover 59 inside the rail housing 55 may be greater than a size of the housing opening 551. Most of the inner surface of the drawer part 32, on which the rail assembly 51 is mounted, except for the gap by the guide slit 511 may be covered by the metal material to improve the outer appearance thereof.

The drawer-side shaft 52 may be disposed on the shaft mounting part 384. The drawer shaft 52 may include the drawer shaft 52, the drawer connection member 522 at the front end of the drawer shaft 521, the drawer gear 523 at the rear end of the drawer shaft 521, and the shaft fixing member 524 allowing the drawer shaft 521 to rotate and fixed to the shaft mounting part 384.

In some implementations, the drawer connection member 522 may be coupled to the front end of the drawer shaft 521, and the drawer connection member 522 may be exposed to both side surfaces of the front surface of the drawer part 32. Also, as described above, the drawer connection member 522 may be coupled to the door connection member 416 when the door part 31 and the drawer part 32 are coupled to each other and may rotate together with the driving of the door-side device 41.

Also, the drawer-side gear 523 may be disposed on the rear end of the drawer shaft 521. The drawer-side gear 523 may have a bevel gear shape and be coupled to the shaft gear 572 through the rail housing 55. That is, the drawer-side shaft 52 and the elevation shaft 57, which are disposed to perpendicularly cross each other, may be connected to each other by the drawer-side gear 523 and the shaft gear 572 to transmit the power.

Also, the shaft fixing member 524 may be disposed on the drawer-side shaft 52. The shaft fixing member 524 may be provided in a pair on both left and right sides to support the drawer-side shaft 52 so that the drawer-side shaft 52 is rotatable without being tilted or moving.

Meanwhile, an implementation of the present disclosure may provide other various structures for elevation of the drawer part other than the drawer-side device and the door-side device. Also, if necessary, a structure for elevation may not be provided.

Hereinafter, a state in which the drawer door 2 of the refrigerator 1 is inserted and withdrawn and is elevated according to an implementation will be described in more detail with reference to the accompanying drawings.

Figure 8:
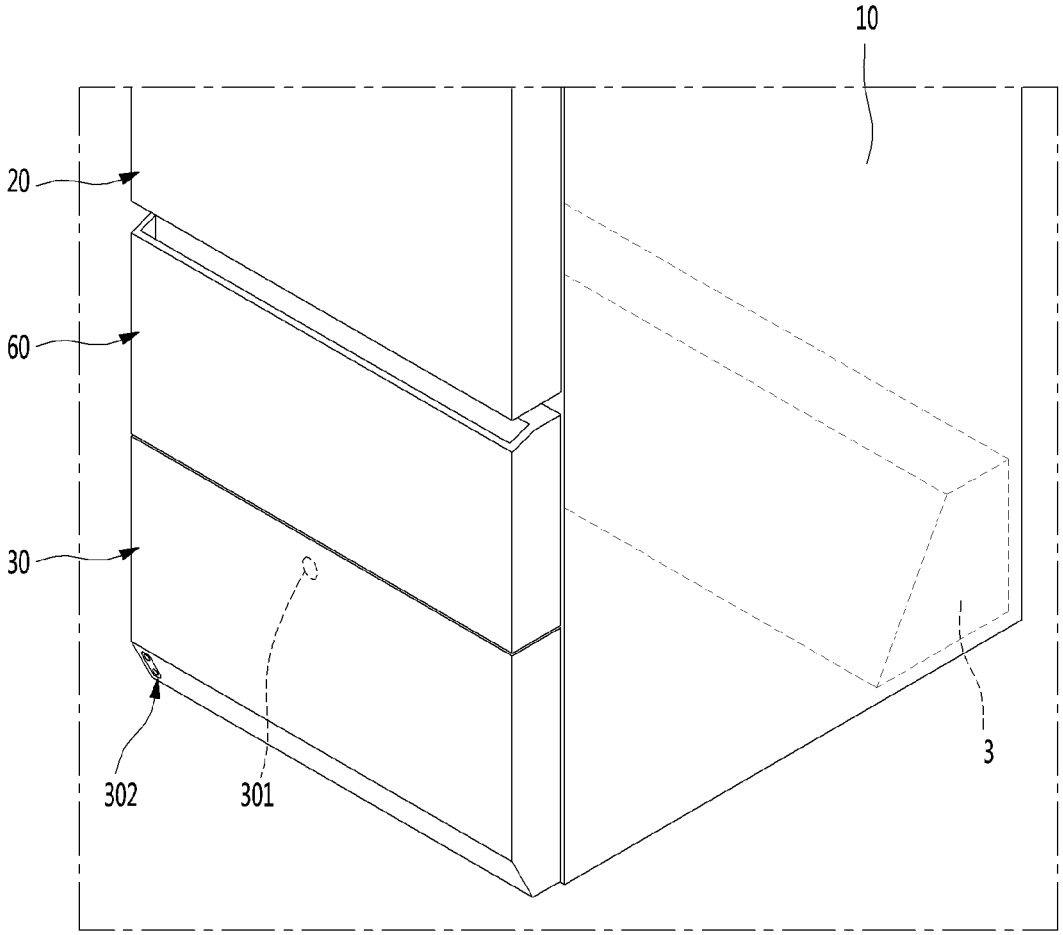
FIG. 8 is a perspective view illustrating a state in which the drawer door is closed.

FIG. 8 is a perspective view illustrating a state in which the drawer door is closed.

As illustrated in the drawing, in the state in which the food is stored, the refrigerator 1 may be maintained in a state in which all of the rotation door 20 and the drawer door 2 are closed. In this state, the user may withdraw the drawer door 2 to accommodate the food.

The drawer door 2 may be provided in plurality in a vertical direction and be withdrawn to be opened by the user's manipulation. Here, the user's manipulation may be performed by touching the manipulation part 301 disposed on the front surface of the rotation door 20 or the drawer door 2. Alternatively, an opening command may be inputted on the manipulation device 302 provided on the drawer door 2. Also, the manipulation part 301 and the manipulation device 302 may individually manipulate the insertion and withdrawal of the drawer door 2 and the elevation of the elevation member 35. Alternatively, the user may hold a handle of the drawer door 2 to open the drawer door 30.

Hereinafter, although the lowermost lower drawer door 30 of the drawer doors 2, which are disposed in the vertical direction, is opened and elevated as an example, all of the upper and lower drawer doors 2 may be inserted and withdrawn and elevated in the same manner.

Figure 9:
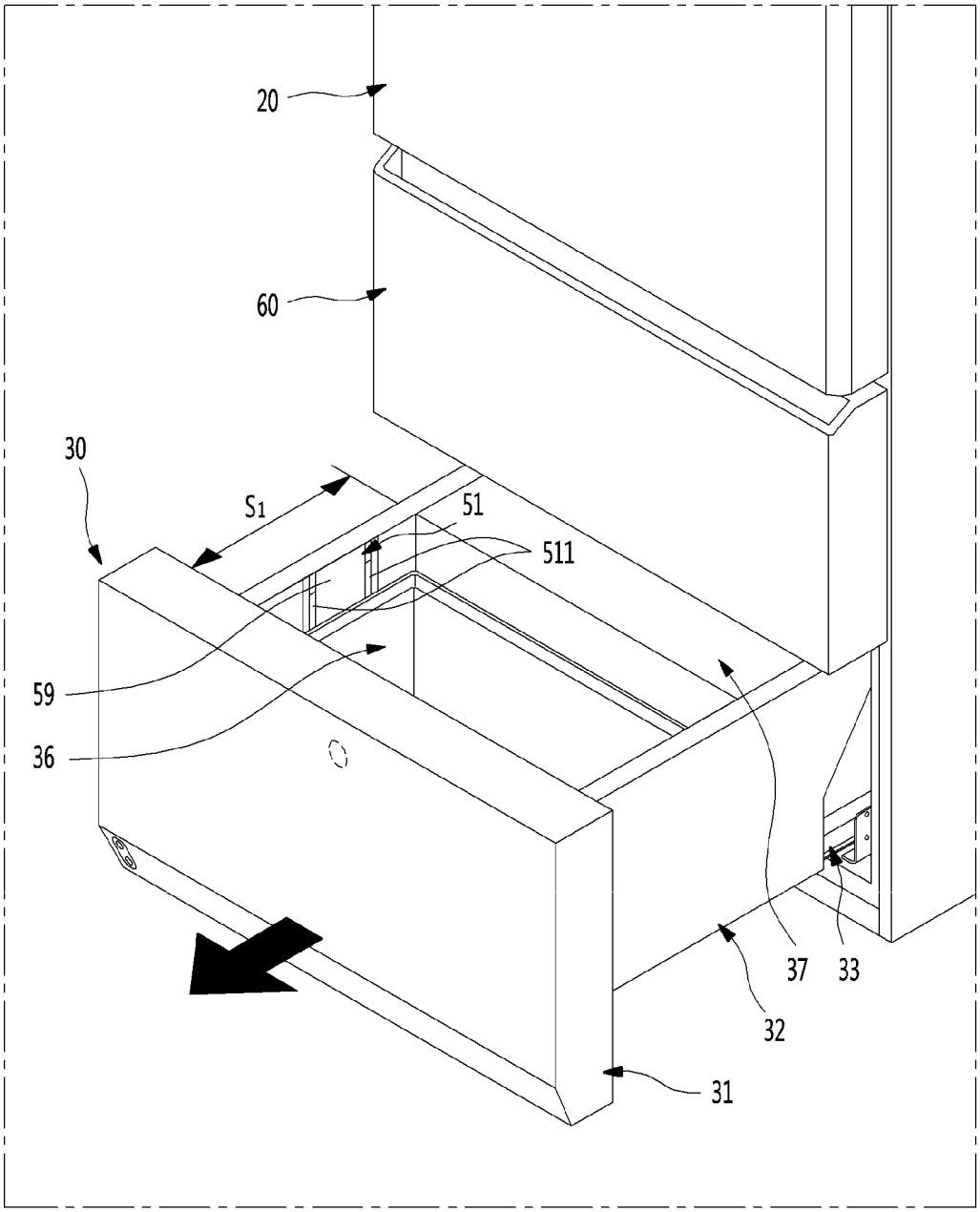
FIG. 9 is a perspective view of a state in which a lower door according to an implementation is completely closed.
Figure 10:
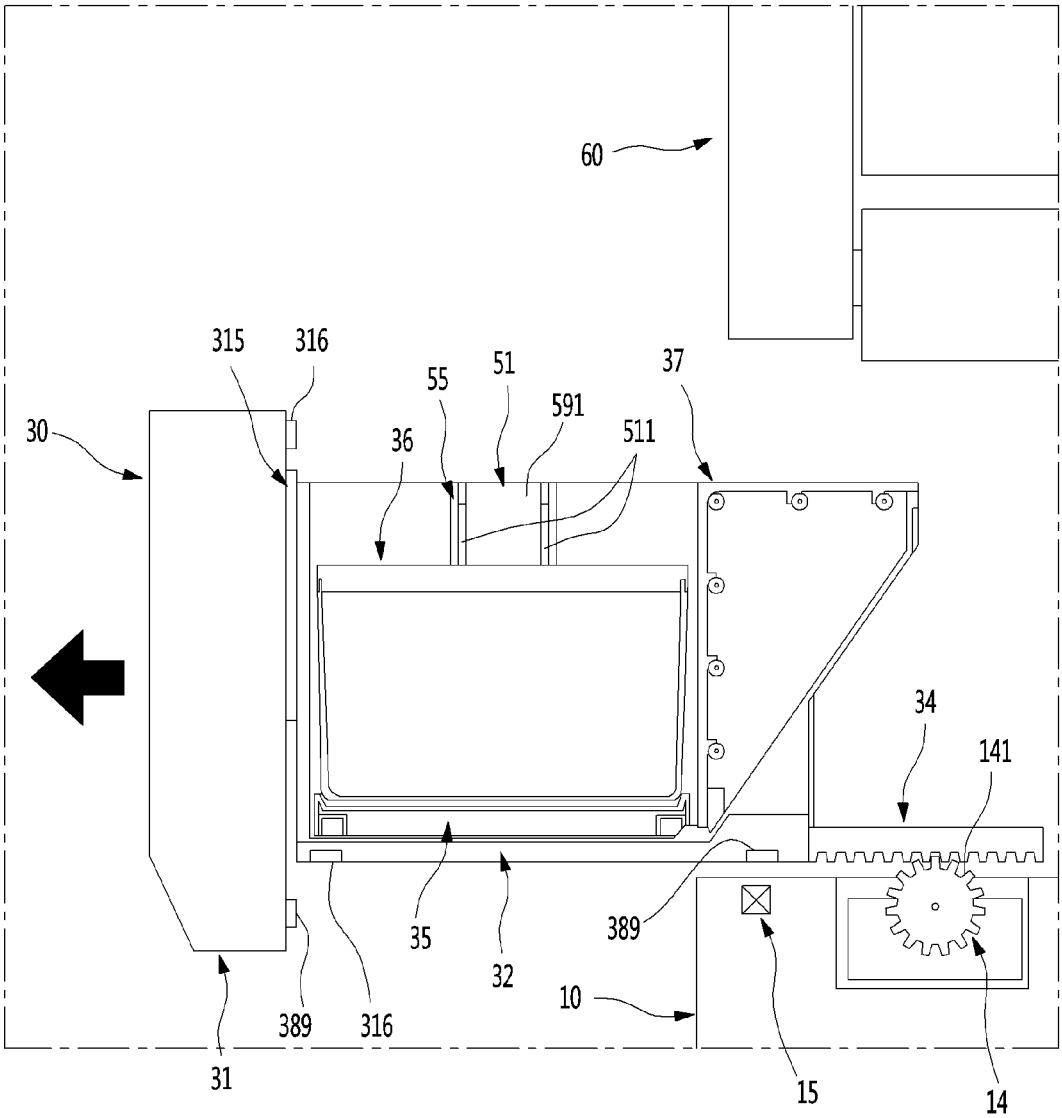
FIG. 10 is a cross-sectional view of the lower door in the state of FIG. 9.

FIG. 9 is a perspective view illustrating a state in which the drawer door is completely opened. FIG. 10 is a cross-sectional view of the drawer door in the state of FIG. 9.

As illustrated in the drawings, the user may manipulate the draw-out operation on the lower door 30 to withdraw the lower door 30 in a forward direction. The lower door 30 may be withdrawn as the draw-out rail 33 becomes extended.

The lower door 30 may be configured to be inserted and withdrawn by the driving of the draw-out motor 14, in lieu of or in addition to a manual method of directly pulling the lower door 30 by the user. The draw-out rack 34 provided on the bottom surface of the lower door 30 may be coupled to the pinion gear 141 rotating when the draw-out motor 14 provided in the cabinet 10 is driven. Thus, the lower door 30 may be inserted and withdrawn according to the driving of the draw-out motor 14.

The draw-out distance of the lower door 30 may correspond to a distance at which the front space S1 within the drawer part 32 is completely exposed to the outside. Thus, in this state, if the upper door 60 is closed, interference may not occur between the elevation member 35 and the upper door 60.

In some implementations, the draw-out distance of the lower door 30 may be determined by a draw-out detection device 15 disposed on the cabinet 10 and/or the lower door 30. The draw-out detection device 15 may be provided as a detection sensor that detects a magnet 389 to detect whether the lower door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the lower door 30 is closed and a position of the magnet 389 when the lower door 30 is completely withdrawn. Thus, the drawn-out state of the lower door 30 may be determined by the draw-out detection device 15.

Also, in some cases, a switch may be provided at each of positions at which the lower door 30 is completely inserted and withdrawn to detect the drawn-out state of the lower door 30. In addition, the drawn-out state of the lower door 30 may be detected by counting the rotation number of draw-out motor 14 and/or measuring a distance between the rear surface of the door part 31 and the front end of the cabinet 10.

In the state in which the lower door 30 is completely withdrawn, the elevation motor 411 may be driven to elevate the elevation member 35. The elevation member 35 may be operated when the lower door 30 is sufficiently withdrawn to secure safe elevation of the food or container 36 seated on the elevation member 35.

That is, in the state in which the lower door 30 is withdrawn to completely expose the front space to the outside, the elevation member 35 may ascend, thus preventing the upper door 60 from interfering with the container 36 or the stored food seated on the elevation member 35.

The ascending of the elevation member 35 may start in a state in which the lower door 30 is completely withdrawn. In some cases, to help improve the user's safety and prevent the food from being damaged, the ascending of the elevation member 35 may start after a set time elapses after the lower door 30 is completely withdrawn.

After the lower door 30 is completely withdrawn, the user may manipulate the manipulation part 301 to input the ascending of the elevation member 35. That is, the manipulation part 301 may be manipulated to withdraw the lower door 30, and the manipulation part 301 may be manipulated again to elevate the elevation member 35. Also, the lower door 30 may be manually inserted and withdrawn by a user's hand. After the lower door 30 is withdrawn, the manipulation part 301 is manipulated to elevate the elevation member 35.

Figure 11:
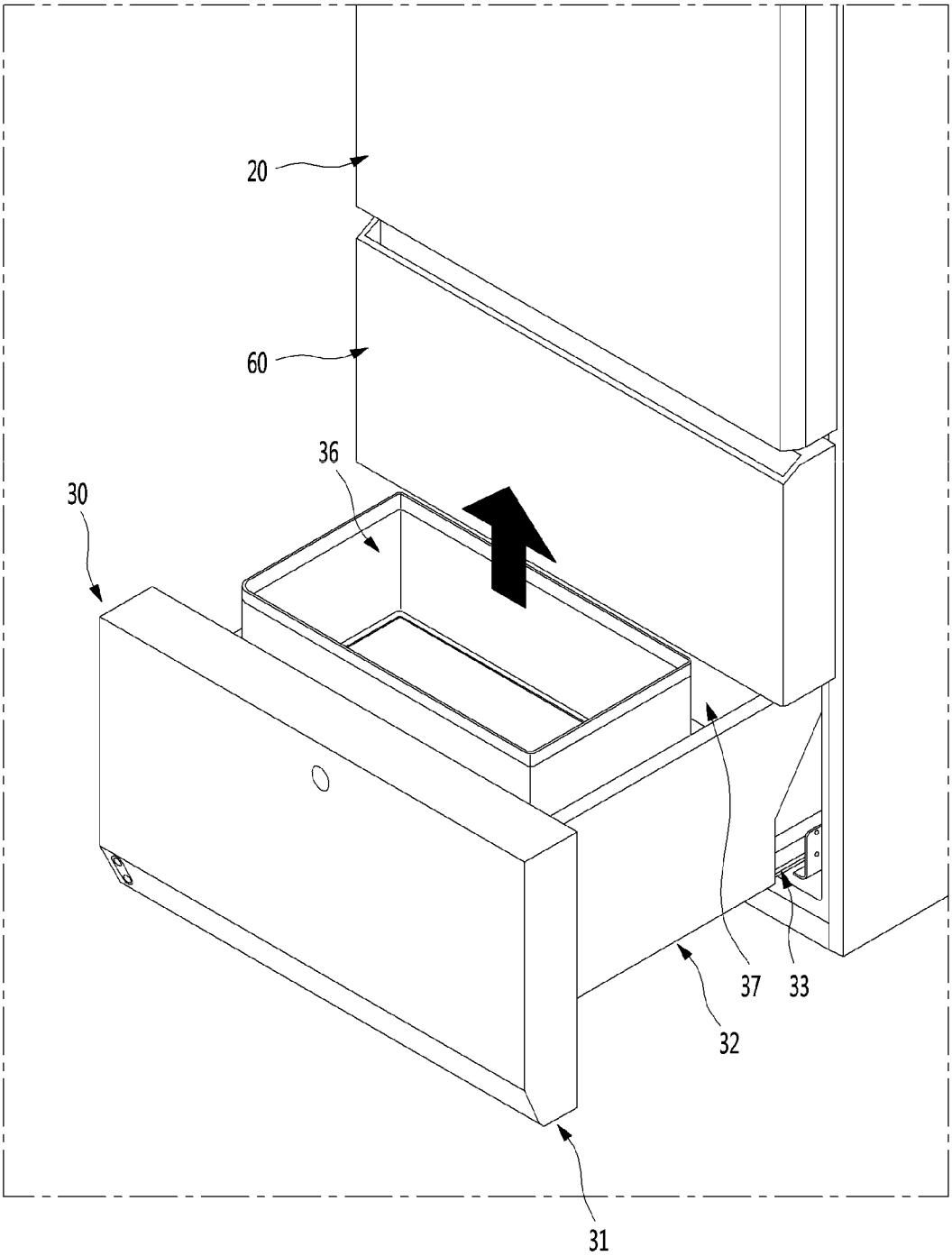
FIG. 11 is a perspective view of a state in which an elevation member of the lower door is completely elevated.
Figure 12:
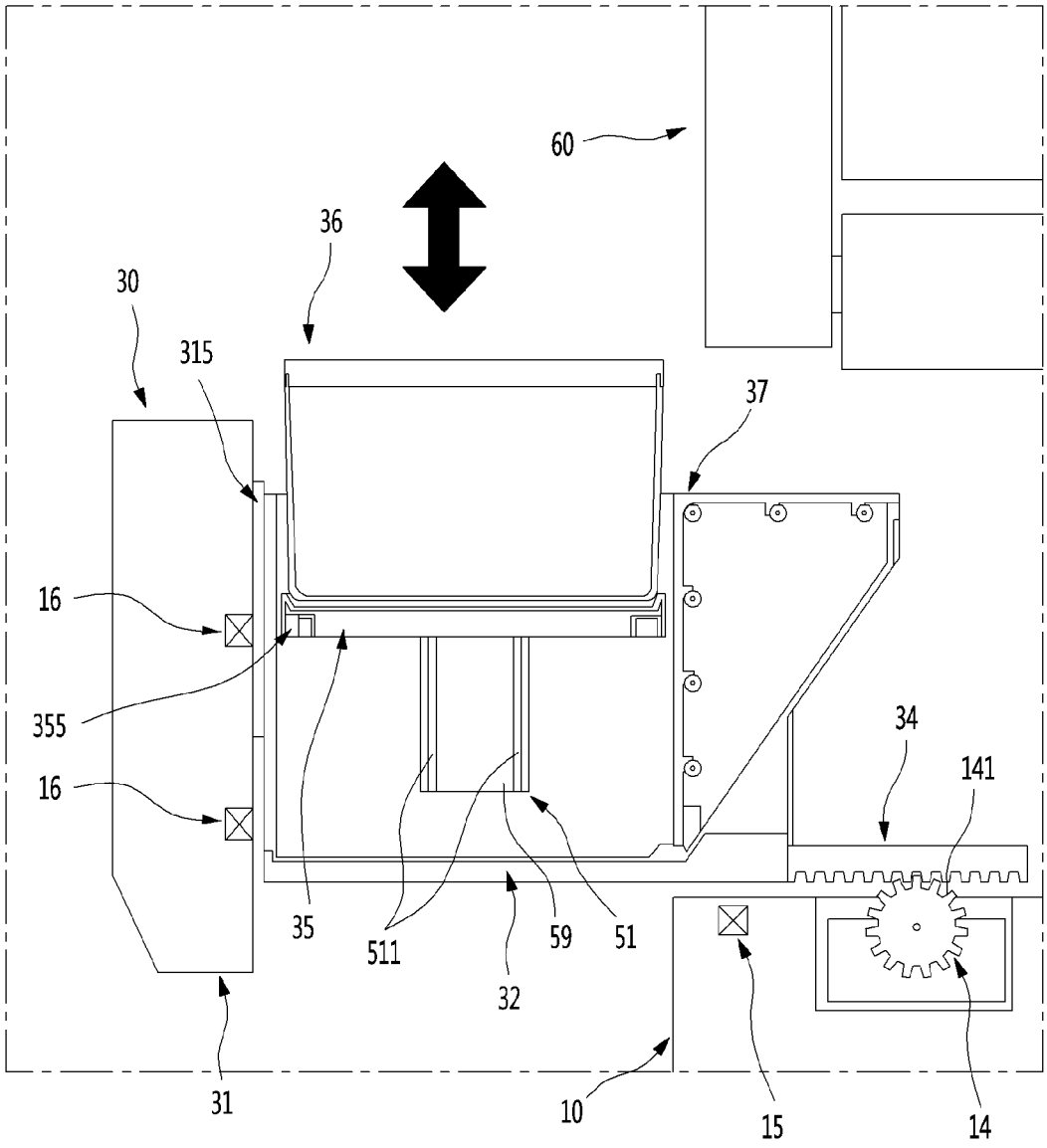
FIG. 12 is a cross-sectional view of the lower door in the state of FIG. 11.

FIG. 11 is a perspective view of a state in which the elevation member of the lower door is completely elevated. FIG. 12 is a cross-sectional view of the lower door in the state of FIG. 11.

As illustrated in the drawings, the elevation of the elevation member 35 may be performed in the state in the lower door 30 is withdrawn. The elevation member 35 may be elevated by the operation of the elevation motor 411. In the state in which the door-side device 41 of the door part 31 and the drawer-side device 50 of the drawer part 32 are coupled to each other, the power may be transmitted to elevate the elevation member 35.

In some implementations, when the elevation motor 411 operates, the door-side shafts 413 connected to the elevation motor 411 may rotate, and also the door-side first gear 414 connected to the door-side shaft 413 may rotate.

The door-side first gear 414 may allow the door connection member 416 exposed to both sides of the rear surface of the door part 31 to rotate in the state of being gear-engaged perpendicularly to the door-side second gear 415. That is, the door-side first gear 414 and the door-side second gear 415 may be gear-coupled so that the direction of the rotation axis is vertically converted.

The rotation force of the door-side device 41 may be transmitted to the drawer-side device 50 by door connection member 416 and the drawer connection member 522, which are coupled to each other. That is, the drawer connection member 522 coupled to the door connection member 416 may rotate, and the drawer-side gear 523 at the end of the drawer shaft 52 may rotate by the rotation of the drawer connection member 522.

The rotation force may be transmitted in the state in which the drawer-side gear 523 and the shaft gear 572 are vertically connected to each other, and the rotation force of the drawer-side shaft 52 may allow the elevation shaft 57 to rotate. That is, the elevation shaft 57 of the rail assembly 51 disposed on both sides of the drawer part 32 may rotate at the same time, and the block holders 56 on both sides may vertically move at the same time along the elevation shaft 57.

The block holder 56 may vertically move together with the connecting bracket 54 in the state of being coupled to the connecting bracket 54, and the elevation member 35 coupled to the connecting bracket 54 may also move upward. Here, the connecting bracket 54 may be connected to a center of both side surfaces of each of the elevation member, and the rail assembly may also be disposed at the center of the elevation member 35 to allow the elevation member 35 to be stably elevated without being tilted.

The elevation member 35 may continuously ascend by a sufficient height so that the user is accessible to the food or container seated on the elevation member 35. Thus, the user may easily lift the food or container.

The elevation member 35 may ascend until the block holder 56 is disposed at the upper end of the guide slit. When the ascending of the elevation member 35 is completed, the driving of the elevation motor 411 is stopped.

When an ascending completion signal is received, the driving of the elevation motor 411 may be stopped. For this, a height detection device 16 for detecting a position of the elevation member 35 may be provided. The height detection device 16 may be provided in the door part 31 at a height corresponding to the uppermost ascending position of the elevation member 35 and the lowermost descending position of the elevation member 35.

The height detection device 16 may be provided as a detection sensor that detects a magnet 355. The height detection device 16 may detect the magnet 355 disposed on the elevation member 35 to determine whether the ascending of the elevation member 35 is completed. Also, the height detection device 16 may be provided as a switch structure to turn on the switch when the elevation member 35 maximally ascends. Also, the height detection device 16 may be provided on the elevation rail 44 or the elevation shaft 57 to detect the maximally ascending position of the elevation member 35. Also, whether the elevation member 35 maximally ascends may be determined according to a variation in load applied to the elevation motor 411.

The driving of the elevation motor 411 is stopped in the state in which the elevation member 35 maximally ascends. In this state, although the elevation member 35 is disposed inside the drawer part 32, the food or container 36 seated on the elevation member 35 may be disposed at a position higher than the opened top surface of the drawer part 32. Accordingly, the user may be able to lift the container 36 without excessively bending his/her waist; thus, it may be possible for the user to perform safer and more convenient operation. That is, the user may more easily access the food or container 36.

After the user's food storing operation is completed, the user may allow the elevation member 35 to descend by manipulating the manipulation part 301. The descending of the elevation member 35 may be performed by a reverse rotation of the elevation motor 411 and may be gradually performed through the reverse procedure with respect to the above-described procedure.

Also, when the descending of the elevation member 35 is completed, i.e., in the state of FIG. 9 or 10, the completion of the descending of the elevation member 35 may be performed by the height detection device 16. The height detection device 16 may be further provided at a position that detects the magnet disposed on the elevation member 35 when the elevation member 35 is disposed at the lowermost descending position. Thus, when the completion of the descending of the elevation member 35 is detected, the driving of the elevation motor can be stopped.

After the driving of the elevation motor 411 is stopped, the lower door 30 may be inserted. Here, the lower door 30 may be closed by the user's manipulation or automatically by the driving of the draw-out motor 14. FIG. 9 illustrates the state when the drawer door 30 is completely closed.

In the refrigerator 1 according to an implementation, when the upper door 60 is withdrawn while the lower door 30 is withdrawn and elevated, the container 36 or food of the lower door 30, which moves upward, and the upper door may collide with each other. To prevent this occurrence, the upper door 60 may be provided with an upper door restriction unit 70 for restricting the upper door 60 when the lower door 30 is withdrawn.

When the upper door 60 and the lower door 30 are simultaneously opened, the center of gravity moves forward, and the refrigerator 1 may tilt forward. Thus, in order to prevent the upper door 60 and the lower door 30 from being simultaneously opened so that the refrigerator 1 falls down forward, a lower door restriction unit 80 that restricts the lower door 30 when the upper door 60 is opened may be provided together with the upper door restriction unit 70.

Hereinafter, the upper door restriction unit 70 the lower door restriction unit will be described in more detail with reference to the drawing.

Figure 13:
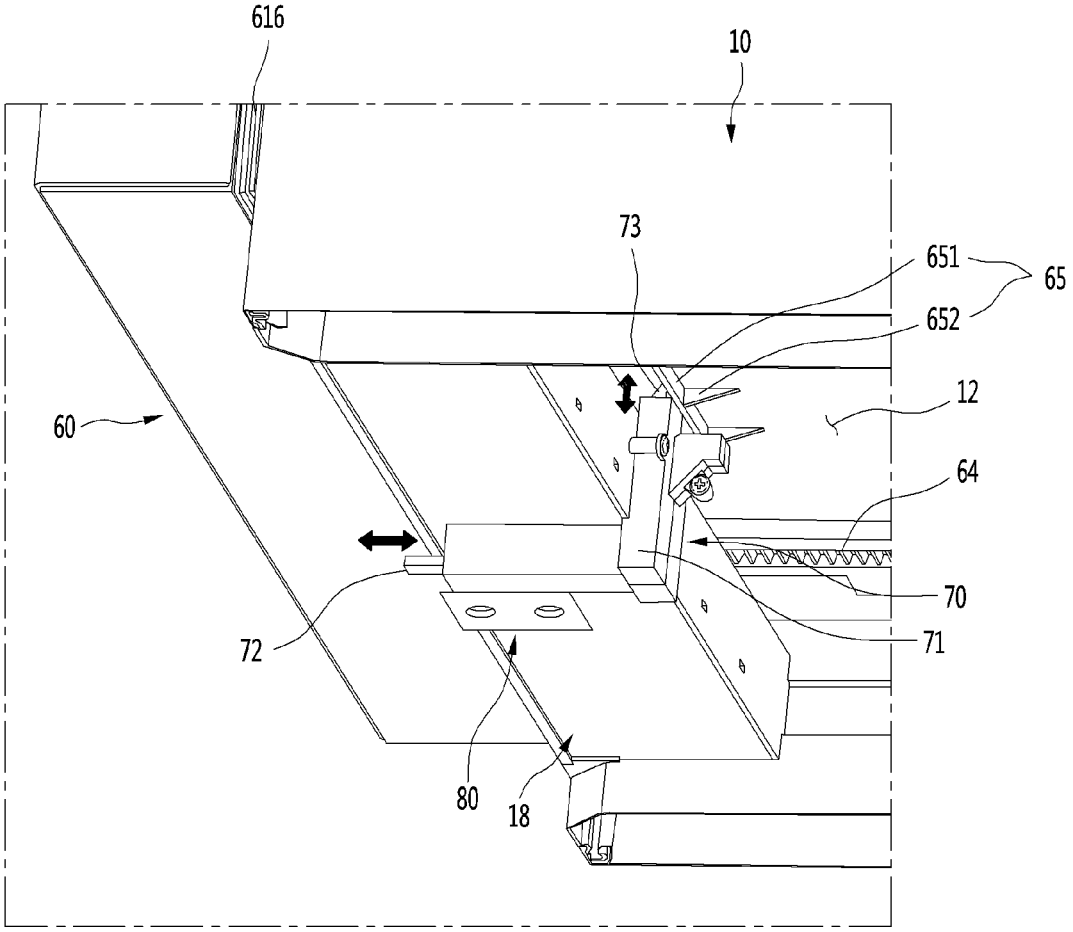
FIG. 13 is a partial cutaway perspective view illustrating a state in which a door restriction unit according to an implementation is mounted.

FIG. 13 is a partial cutaway perspective view illustrating a mounted state of the door restriction unit according to an implementation.

As illustrated in the drawing, the partition member 18 may be provided inside the cabinet 10 of the refrigerator 1 according to an implementation.

The partition member 18 may be provided on the inner front end of the lower storage chamber 12 and extend from the left end to the right end to partition the front end of the lower storage 12. The upper door 60 may be disposed above the partition member 18, and the lower door 30 may be disposed to be insertable and withdrawable. The upper and lower portions of the lower storage chamber 12 may be completely partitioned by the partition member 18 and may be substantially divided into a space in which the upper door 60 and the lower door 30 are provided, and the upper door 60 and the lower door 30 may be partitioned by the partition member 18 only at the front end of the lower storage chamber 12.

Also, the front end of the partition member 18 may be configured to contact the upper door 60 and the rear surface of the door part 31 of the lower door 30. That is, the upper door 60 and the gasket 317 on the rear surface of the door part 31 of the lower door 30 may contact the front surface of the partition member 18 to seal the upper door 60 and the lower door 30.

The door restriction unit may be provided on one side of the partition member 18. The door restriction unit may include an upper door restriction unit 70 that restricts the upper door 60 and a lower door restriction unit 80 that restricts the lower door. The upper door restriction unit 70 and the lower door restriction unit 80 may be separately configured and each may be mounted on the partition member 18.

First, the upper door restriction unit 70 is described. The upper door restriction unit 70 may be configured to selectively restrict the upper door 60 depending on whether the lower door 30 is opened or closed.

The upper door restriction unit 70 may include a push member 72, which is mounted on edges of the rear and bottom surfaces of the partition member 18 and pressed by the lower door 30 when the lower door 30 is closed, and a first slider 73 that is configured to be vertically moved by the push member 72. The first slider 73 may protrude upward when the lower door 30 is closed and may hook the door restriction part 65 of the upper door 60.

The door restriction part 65 may be provided on the bottom surface of the upper door 60 and may be disposed at a position corresponding to the first slider 73 in the state in which the upper door 60 is closed.

The door restriction part 65 may include a restriction rib 651 extending downward and a reinforcement rib 652 extending in the cross direction from the rear side of the restriction rib 651. The upper end of the slider 73 may contact the front surface of the restriction rib 651. When the slider 73 and the door restriction part 65 are restricted, the upper door 60 may be restricted, and thus, the forward withdrawal of the upper door 60 may be impossible.

The lower door restriction unit 80 may be provided at a side of the upper door restriction unit 70. The lower door restriction unit 80 may be mounted to be restricted with the bottom surface of the lower door 30 through the partition member 18. Also, a locking member 84 may be exposed below the partition member 18. The locking member 84 may be configured to be restricted with a side of the rear surface of the lower door 30 when the upper door 60 is opened.

Figure 14:
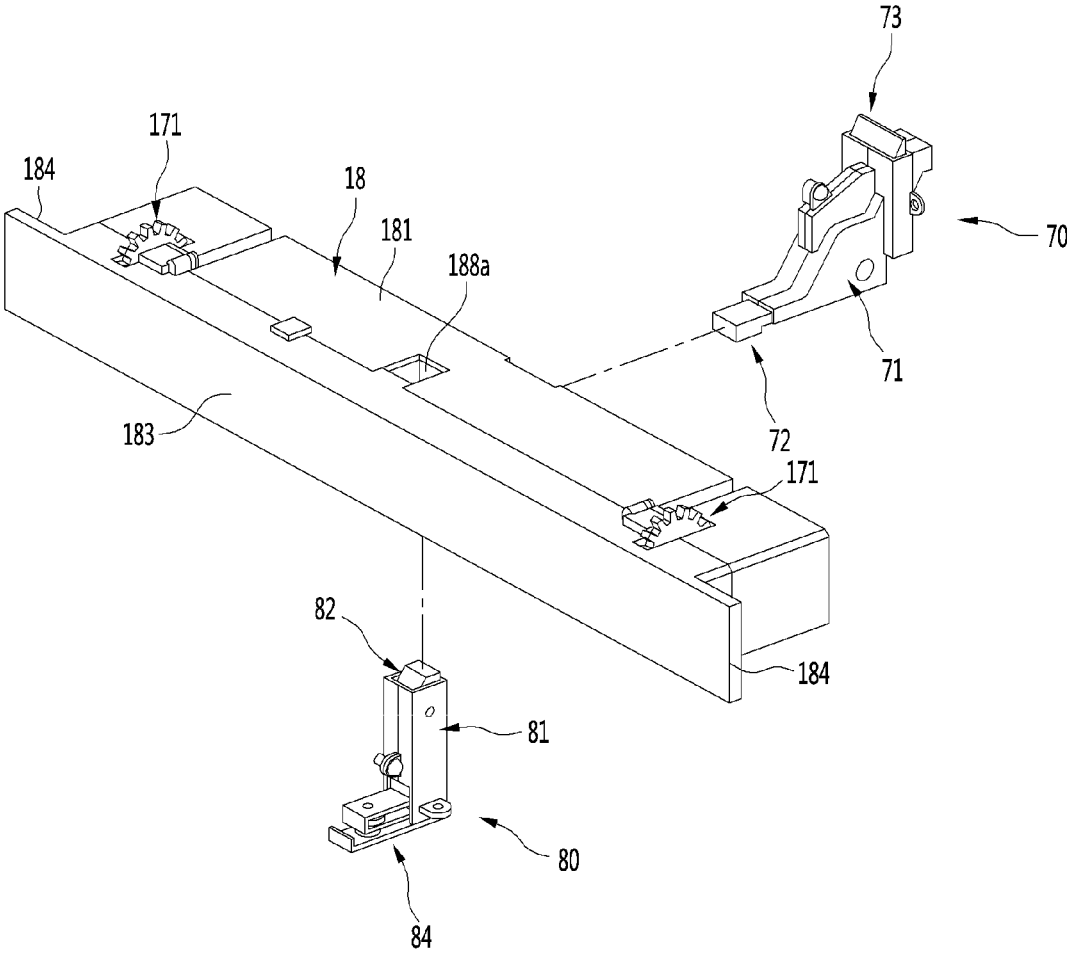
FIG. 14 is an exploded front perspective view illustrating a mounting structure of the door restriction unit.
Figure 15:
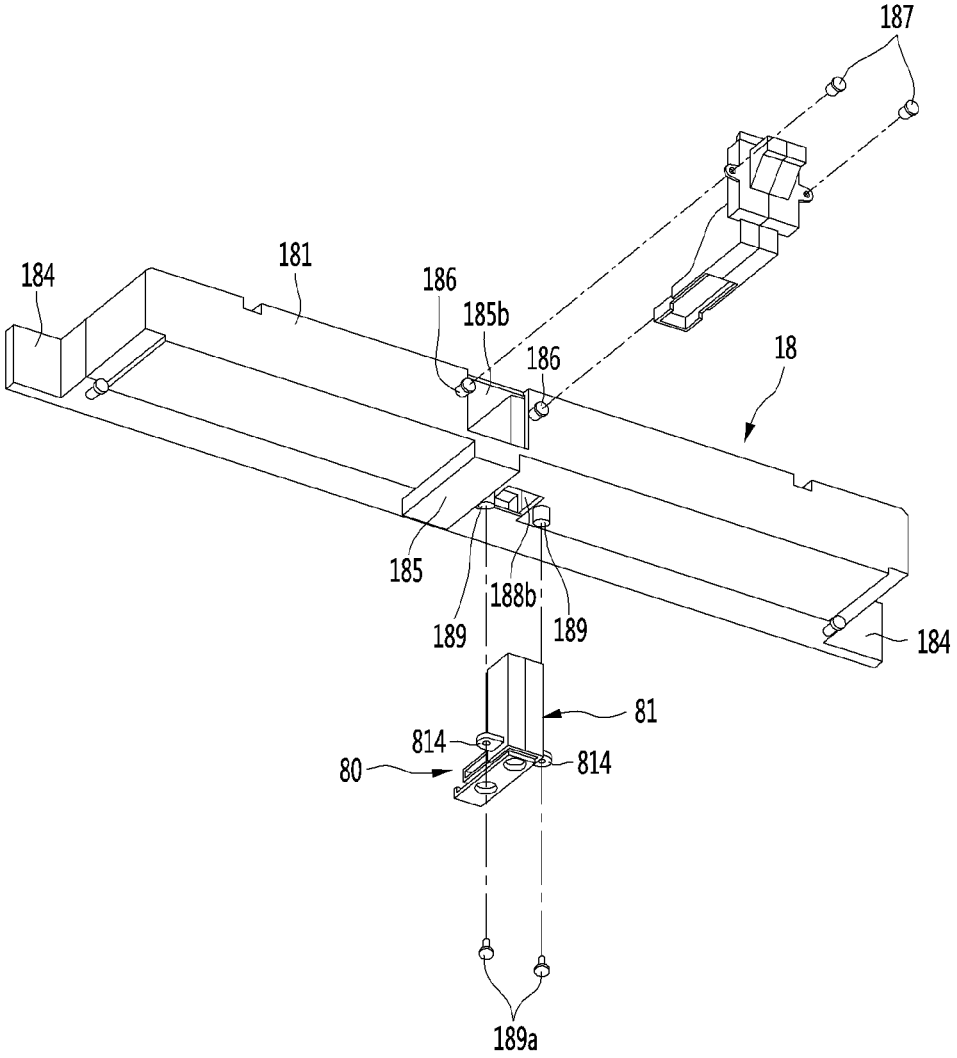
FIG. 15 is an exploded rear perspective view illustrating the mounting structure of the door restriction unit.

FIG. 14 is an exploded front perspective view illustrating a mounting structure of the door restriction unit. FIG. 15 is an exploded rear perspective view illustrating the mounting structure of the door restriction unit.

Referring to the drawings, the partition member 18 may be defined in outer shape by a partition member case 181 made of a plastic injection material and may be filled with an insulation material 182. Also, a front plate 183 having a metal plate shape may be disposed on a front surface of the partition member 18. Thus, when the upper door 60 and the lower door 30 are closed, the gasket and the front plate 183 may be closely attached to each other to provide a seal between the upper door 60 and the lower door 30.

The upper draw-out motor 17 and the upper pinion 171 may be provided in the partition member 18. The upper draw-out motor 17 and the upper pinion 171 may be provided on both sides of the partition member 18, and a pair of upper pinions 171 may be exposed through the upper surface of the partition member 18 and may be configured to be gear-coupled to the upper draw-out rack 64 on the bottom surface of the upper door 60.

Only one upper draw-out motor 17 may be provided on the inner side of the partition member 18 so that the upper pinions 171 on both sides are connected by a shaft and rotate by one upper draw-out motor 17.

The upper draw-out motor 17 is driven by the user's input manipulation so that the upper pinion 171 rotates forward. Thus, the upper pinion 171 moves along the upper draw-out rack 64, and the upper door 60 may be automatically inserted and withdrawn. The upper door 60 may not be inserted and withdrawn when the upper door 60 is restricted by the upper door restriction unit 70.

The draw-out motor 17 may not be provided inside the partition member 18, and here, only the upper pinions 171 may be disposed on both sides of the partition member 18. A pair of upper pinions 171 may be coupled to the upper draw-out rack 64 formed on the bottom surface of the upper door 60. Thus, when the upper door 60 is inserted and withdrawn, the upper door 60 can be inserted and withdrawn by the same amount simultaneously at the left and right sides without inclining.

A partition member fixing part 184 for fixing the partition member 18 to the cabinet 10 may be disposed on each of both sides of the partition member 18. Also, an upper restriction unit mounting part 185 to which the upper door restriction unit 70 is mounted may be disposed at the center of the partition member 18.

The upper restriction unit mounting part 185 may be disposed on the bottom surface of the partition member 18. Also, the partition member case 181 may protrude downward to provide a space in which the upper door restriction unit 70 is accommodated.

Also, the upper restriction unit mounting part 185 may include a rear opening **185*b* for allowing the upper door restriction unit 70 to be inserted from the rear side and a front opening for allowing the front end of the push member 72 of the upper door restriction unit 70 to protrude. Thus, the push member 72 may protrude through the front opening 185*a* in the state in which the upper door restriction unit 70 is mounted on the upper restriction unit mounting part 185 through the rear opening 185*b***.

Also, a first mounting boss 186 protruding in a rearward direction may be disposed on each of both right and left sides of the rear opening **185*b*. The first mounting boss 186 may be disposed at a position corresponding to the first case mounting part 711 on each of both sides of the upper door restriction unit 70, and a screw 187 passing through the first case mounting part 711 may be coupled to the upper door restriction unit 70 to allow the upper door restriction unit 70 to be maintained in the state in which the upper door restriction unit 70 is fixedly mounted on the partition member 18**.

Lower restriction unit mounting parts **188*a* and 188*b* to which the lower door restriction unit 80 is mounted may be disposed on the partition member 18. The lower restriction unit mounting part 188*a* and 188*b* may be formed through the top surface and the bottom surface of the partition member 18. Thus, the lower door restriction unit 80 may be mounted vertically through the partition member 18**.

The restriction unit mounting parts **188*a* and 188*b* may include an upper opening 188*a* and a lower opening 188*b*. The upper opening 188*a* and the lower opening 188*b*** may be respectively formed in directions facing each other to communicate with each other.

In some implementations, the sizes of the upper opening **188*a* and the lower opening 188*b* may correspond to the size of the lower restriction unit case 81. Thus, the lower restriction unit case 81 may be mounted through the upper opening 188*a* and the lower opening 188*b***.

Also, a second mounting boss 189 may be disposed on each of both sides of the lower opening **188*b*. For the second mounting boss 189, second case mounting parts 814 protruding from both sides of the lower restriction unit case 81 may be fixed by fastening screws 189*a*. Thus, the lower door restriction unit 80 may be fixedly mounted through the partition member 18** at a lower portion.

In a state in which the lower door restriction unit 80 is mounted in the lower restriction unit mounting parts **188*a* and 188*b*, the locking member 84 of the lower door restriction unit 80 maintains the exposed state below the partition member 18. Also, the upper end of the second slider 82 coupled to the locking member 84 may selectively protrude over the partition member 18**.

Hereinafter, the upper door restriction unit 70 will be described in more detail with reference to the drawings.

Figure 16:
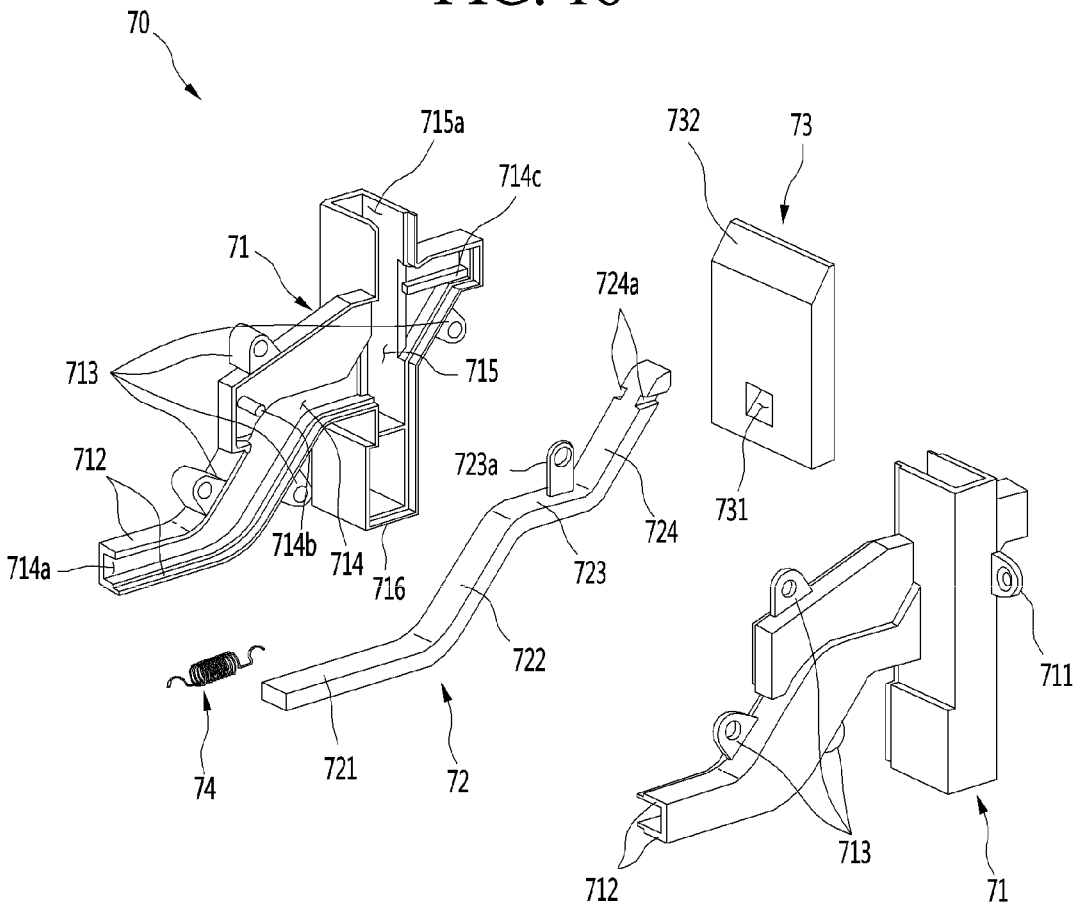
FIG. 16 is an exploded perspective view illustrating the coupling structure of an upper door restriction unit according to an implementation.
Figure 17:
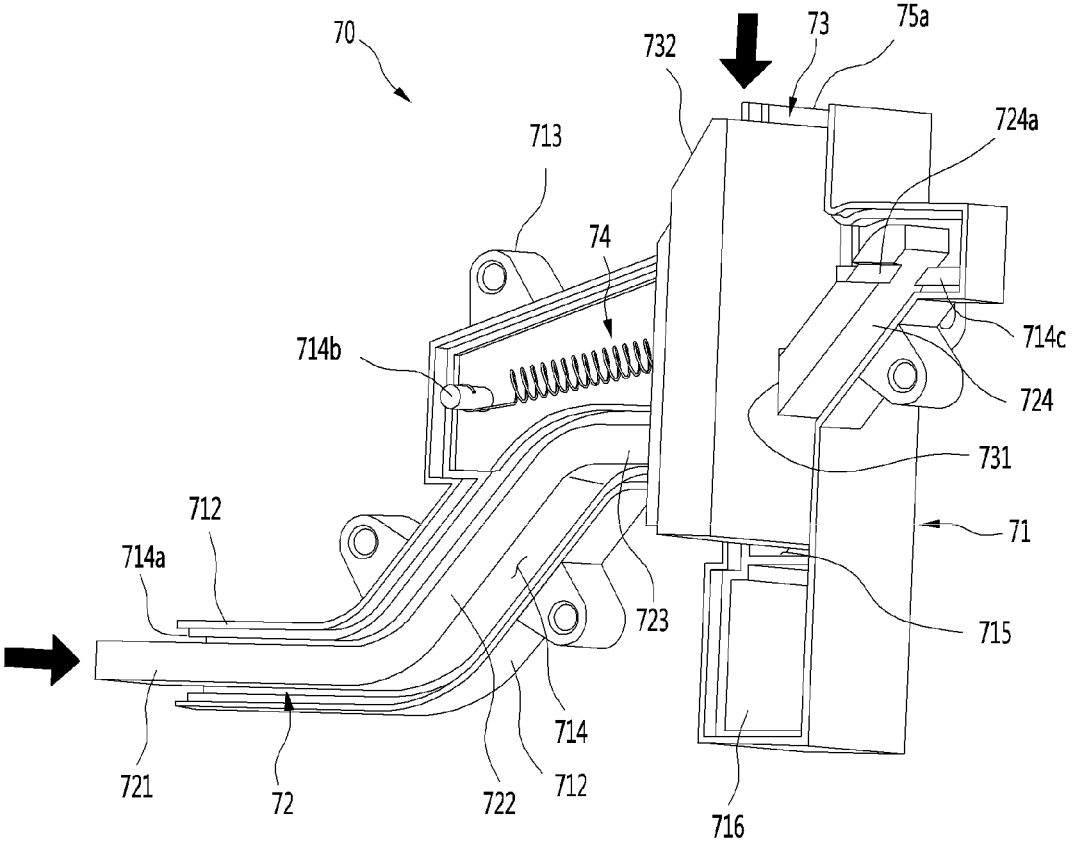
FIG. 17 is a cutaway perspective view illustrating a state in which the upper door restriction unit is restricted.
Figure 18:
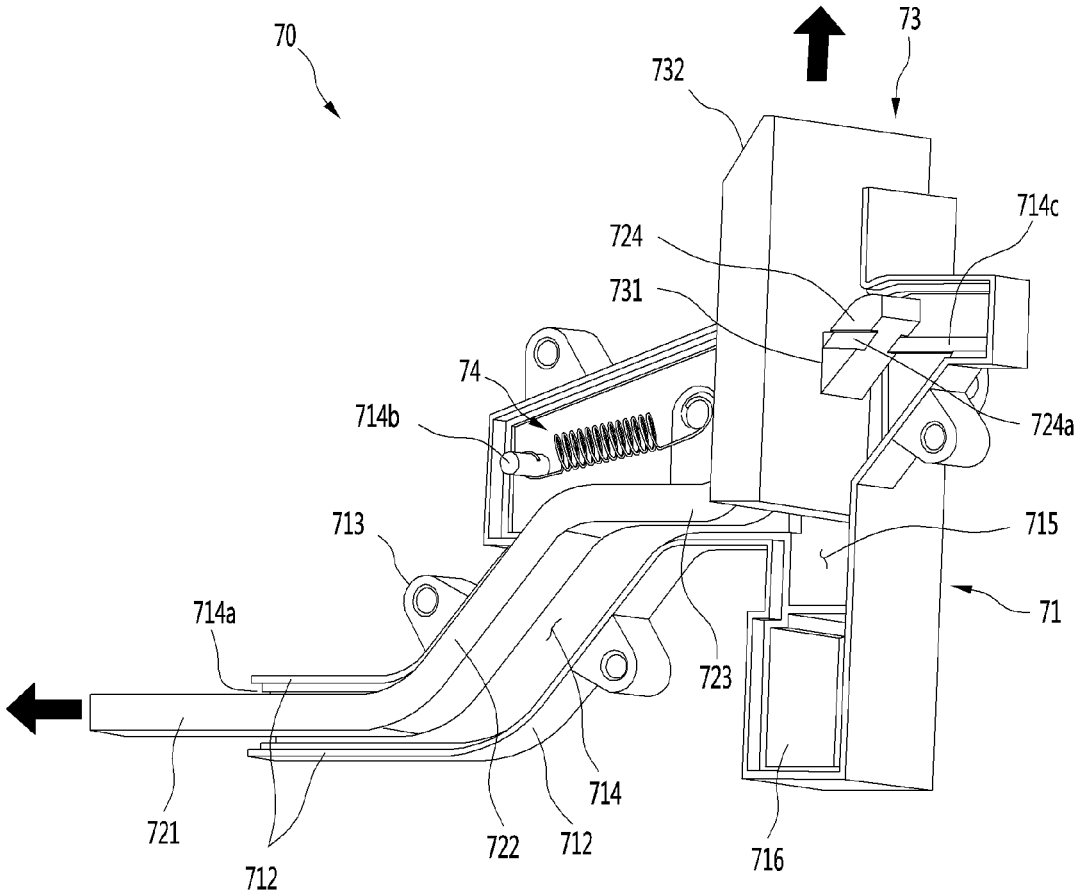
FIG. 18 is a cutaway perspective view illustrating a state in which the upper door restriction unit is not restricted.

FIG. 16 is an exploded perspective view illustrating the coupling structure of the upper door restriction unit. Also, FIG. 17 is a cutaway perspective view illustrating a state in which the upper door restriction unit is restricted. Also, FIG. 18 is a cutaway perspective view illustrating a state in which the upper door restriction unit is not restricted.

As illustrated in the drawings, the upper door restriction unit 70 may include the pair of upper restriction cases 71, the push member 72 within the upper restriction unit case 71, the slider 73, and an upper elastic member 74.

The upper restriction unit case 71 may be provided in a pair on left and right sides, which are coupled to each other to define a space therein. The upper restriction unit case 71 may have a space in which the push member 72 moves in the forward and backward direction and a space in which the first slider 73 moves in the vertical direction. Thus, the push member 72 and the first slider 73 may be accommodated in a movable state.

The upper restriction unit case 71 may have the same structure on both left and right sides, and an edge 712 may be disposed along the outer circumference thereof. Thus, when the pair of upper restriction unit cases 71 are coupled to each other, a space in which the push member 72 and the first slider 73 are disposed may be defined.

Also, a plurality of case coupling parts 713 may be disposed on the edge 712. The case coupling parts 713 may be disposed at positions corresponding to the respective upper restriction unit cases 71 on both sides, and the upper restriction unit cases 71 on both sides may be coupled to each other through screw coupling. Also, a push member opening 714*a* through which an end portion of the push member 72 is inserted and withdrawn may be disposed at the front end of the upper door restriction unit 70 in a state where the upper restriction unit cases 71 are coupled to each other, and a first slider opening 715*a* through which the first slider 73 is accessible may be defined in an upper end of the upper door restriction unit.

Also, the space defined in the upper restriction unit case 71 may include a push member accommodation part 714 and a first slider accommodation part 715.

The push member accommodation part 714 may have a shape corresponding to that of the push member 72 and extend forward and backward so that the push member 72 is accommodated therein. Also, the inside of the push member accommodation part 714 may have a predetermined width by a movement distance of the push member 72 so as not to interfere with the push member 72 when the push member 72 moves forward and backward.

Also, the push member accommodation part 714 may accommodate the upper elastic member 74 that provides elastic force when the push member 72 moves to return to its original position. The upper elastic member 74 may be a spring having a coil shape, for instance, and both ends of the upper elastic member 74 may be connected to the upper restriction unit case 71 and the push member 72, respectively. Thus, the upper elastic member 74 may provide elastic force when the push member 72 moves.

Also, a first upper fixing part 714*b* may be provided inside the push member accommodation part 714 The first upper fixing part 714*b* may protrude from the inside of the push member accommodation part 714 so as to be fixed to one end of the upper elastic member 74.

Also, a movement guide 714*c* for guiding the push member 72 forward and backward may protrude from a side of the push member accommodation part 714. The movement guide 714*c* may be accommodated in a guide groove 724*a* defined in each of both sides of the push member 72 to guide the push member 72 forward and backward. The movement guide 714*c* may be disposed in the front and rear direction in which the push member 72 moves and may be provided to correspond to at least the movement distance of the push member 72 in the front and rear direction.

Also, a front end of the push member accommodation part 714 may be opened to define the push member opening 714*a*. Also, the push member accommodation part 714 may cross the first slider accommodation part 715.

The first slider accommodation part 715 may be disposed at a position corresponding to an inclined part of the push member 72 in the push member accommodation part 714. The first slider accommodation part 715 may vertically extend in a rear part of the push member accommodation part 714 and may be disposed to cross the push member accommodation part 714.

The first slider accommodation part 715 may be provided to completely accommodate the first slider 73. Also, the lower end of the first slider accommodation part 715 may be configured to support the lower surface of the first slider 73 in a state in which the first slider 73 completely move downward. The upper end of the first slider accommodation part 715 may provide the upper end of the upper restriction unit case 71, and the first slider opening 715*a* may be defined in the upper end of the first slider accommodation part 715.

Also, in a state in which the first slider 73 positioned at the lowermost position, the first slider accommodation part 715 may extend upward so that the upper end of the first slider 73 is not exposed through the upper end of the first slider accommodation part 715, i.e., the first slider opening 715*a*. Also, when the first slider 73 moves upward by the movement of the push member 72, the upper end of the first slider 73 may protrude outward over the first slider opening 715*a*.

A restriction unit insertion part 716 may be further provided below the first slider accommodation part 715 and extend further downward in the extending direction of the first slider accommodation part 715. Also, the restriction unit insertion part 716 may be inserted into the upper restriction unit mounting part 185 to maintain the fixed state of the upper door restriction unit 70. Also, each of the restriction unit insertion part 716 and the first slider accommodation part 715 may have a width greater than that of the push member accommodation part 714 to completely cover a rear opening 185*b* of the upper restriction unit mounting part 185.

The push member 72 may have a size and shape that is enough to be accommodated inside the push member accommodation part 714 and contact the lower door 30 through the push member opening 714*a*. Also, the push member may slidably move forward and backward inside the push member accommodation part 714 according to the contact state with the lower door 30.

The push member 72 may include horizontal parts 721 and 723 moving forward and backward and contacting the lower door 30 and inclined parts 722 and 724 inclinedly extending with respect to the horizontal parts 721 and 723 to allow the first slider 73 to move vertically. The horizontal parts 721 and 723 and the inclined parts 722 and 724 may be provided in plurality as necessary and may have number suitable for contacting the lower door 30 and for elevating the first slider 73.

In this implementation, the horizontal part may include a first horizontal part 721 and a second horizontal part 723. The inclined part may include a first inclined part 722 and a second inclined part 724.

In more detail, the first horizontal part 721 provides a front end of the push member 72, and the front end may be configured to be inserted and withdrawn through the push member opening 714*a*. Also, the first horizontal part 721 may be disposed to perpendicularly cross the first slider 73.

The first inclined part 722 may extends inclinedly from the rear end of the first horizontal part 721 and extend upward and backward to have a predetermined inclination. The first inclined part 722 may be disposed between the first horizontal part 721 and the second horizontal part 723, and the arrangement position of the first slider 73 may be determined by a length of the first inclined part 722.

A second horizontal part 723 may be disposed on a rear end of the first inclined part 722. The second horizontal part 723 may extend backward and may extend by a predetermined length so as to be disposed at a position at which the second inclined part 724 crosses the first slider accommodation part 715. Also, the second horizontal part 723 may be parallel to the first horizontal part 721.

Also, a second upper fixing part 723*a* to which the end of the upper elastic member 74 is fixed may be disposed on the second horizontal part 723. The second upper fixing part 723*a* may extend upward from one side of the second horizontal part 723 to fix the end portion of the upper elastic member 74. Thus, the upper elastic member 74 may be fixed by the first upper fixing part 714*b* and the second upper fixing part 723*a*. When the push member 72 may move backward into the state, as shown in FIG. 18, the upper elastic member may be tensioned. The pushing member 72 may move forward as shown in FIG. 17 by the elastic force of the upper elastic member 74 to return to its initial state when the external force is removed.

The second inclined part 724 may extend backward and upward from the rear end of the second horizontal part 723. Also, the second inclined part 724 may extend through the first slider 73 to the rear end of the push member accommodation part 714. Thus, the first slider 73 may move in the vertical direction according to the movement of the push member 72 in the longitudinal direction.

A guide groove may be further provided in each of both side surfaces of the second inclined part 724 corresponding to the movement guide 714*c*. The movement guide 714*c* may be inserted into the guide groove 724*a* when the push member 72 is mounted. Thus, the push member 72 may horizontally move by the movement guide 714*c* when moving forward and backward.

The first inclined part 722 and the second inclined part 724 may move together when the push member 72 moves forward and backward. Thus, a portion of each of the first inclined part 722 and the second inclined part 724 of the upper restriction unit case 71 may have a width greater than a thickness of each of the first inclined part 722 and the second inclined part 724 so as not to interfere the first inclined part 722 and the second inclined part 724 even when the first inclined part 722 and the second inclined part 724 move.

The first slider 73 may be accommodated inside the first slider accommodation part 715 and may be penetrated by the push member 72 in the mounted state. The first slider 73 may have a horizontal width larger than that of the push member 72, and a through-hole 731 may be defined in a center of a lower portion thereof.

Also, the first slider 73 may have a shape corresponding to the width and thickness of the first slider accommodation part 715 and may be movable only in the vertical direction when the slider is accommodated inside the first slider accommodation part 715.

The through-hole 731 may be defined to be penetrated by the second inclined part 724 of the push member 72. The inner top surface and bottom surface of the through-hole 731 may be defined to have an inclination corresponding to that of the second inclined part 724.

Thus, when the push member 72 moves forward and backward while the first slider 73 is penetrated by the second inclined part 724, the first slider 73 accommodated in the first slider accommodation part 715 may vertically move along the inclined surface of the second inclined part 724.

The upper end of the first slider 73 may protrude upward from the first slider opening 715*a* and may be disposed at the highest position in a state where the push member 72 completely moves backward.

Also, when the first slider 73 is disposed at the highest position, the end of the first slider 73 may be restricted and coupled to the door restriction part 65. Also, an inclined surface 732 may be provided on the upper end of the first slider 73. The upper end of the first slider 73 may have a height that gradually increases from the front side to the rear side by the inclined surface 732. Thus, when the upper end of the first slider 73 protrudes above the first slider opening 715*a* in a state in which the upper door 60 is opened, the door restriction part 65 may contact the inclined surface 732 to allow the first slider 73 to move downward, thereby preventing the drawer restriction unit 70 from being damaged.

Hereinafter, the restricted state and the release state of the restriction of the upper door 60 due to the insertion and the withdrawal of the lower door 30 of the refrigerator 1 having the above-described structure according to an implementation will be described.

Figure 19:
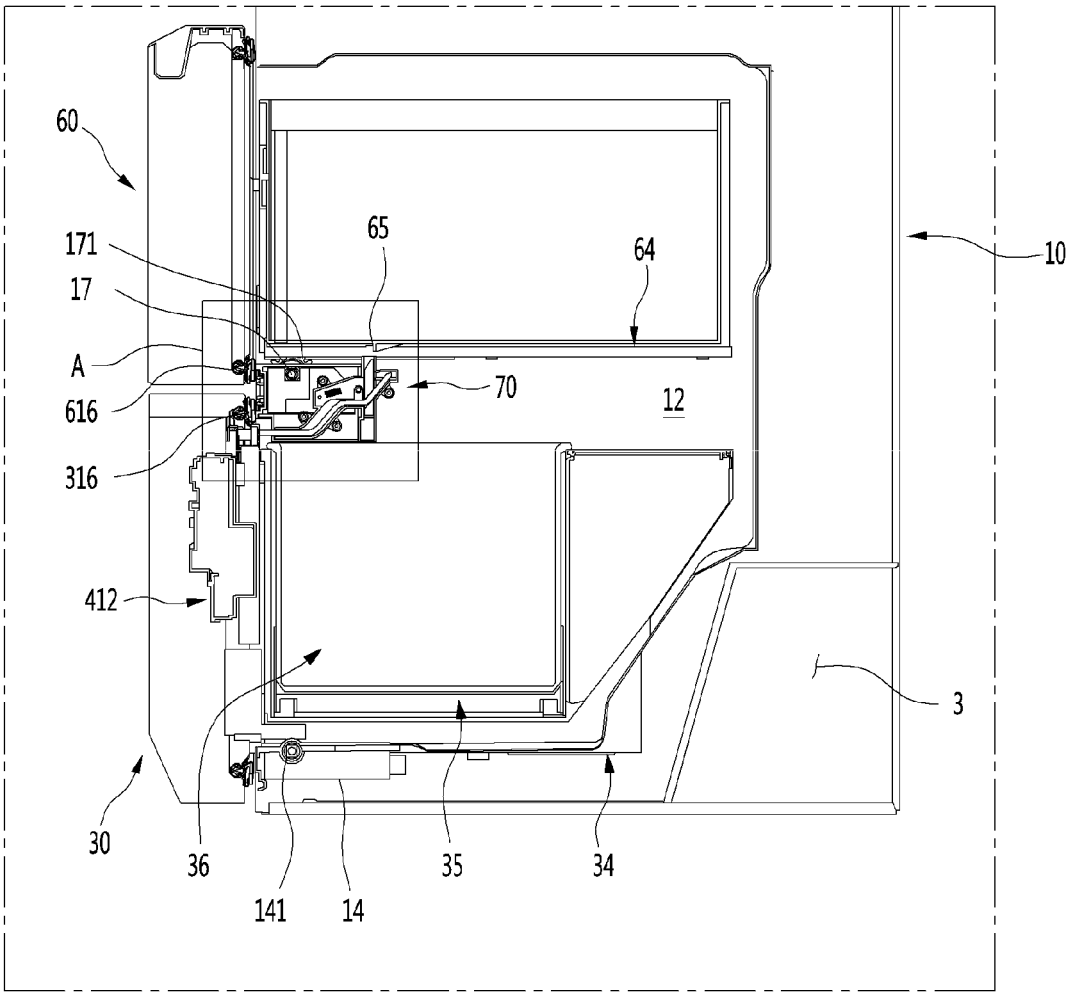
FIG. 19 is a view illustrating a state in which the drawer door is closed.
Figure 20:
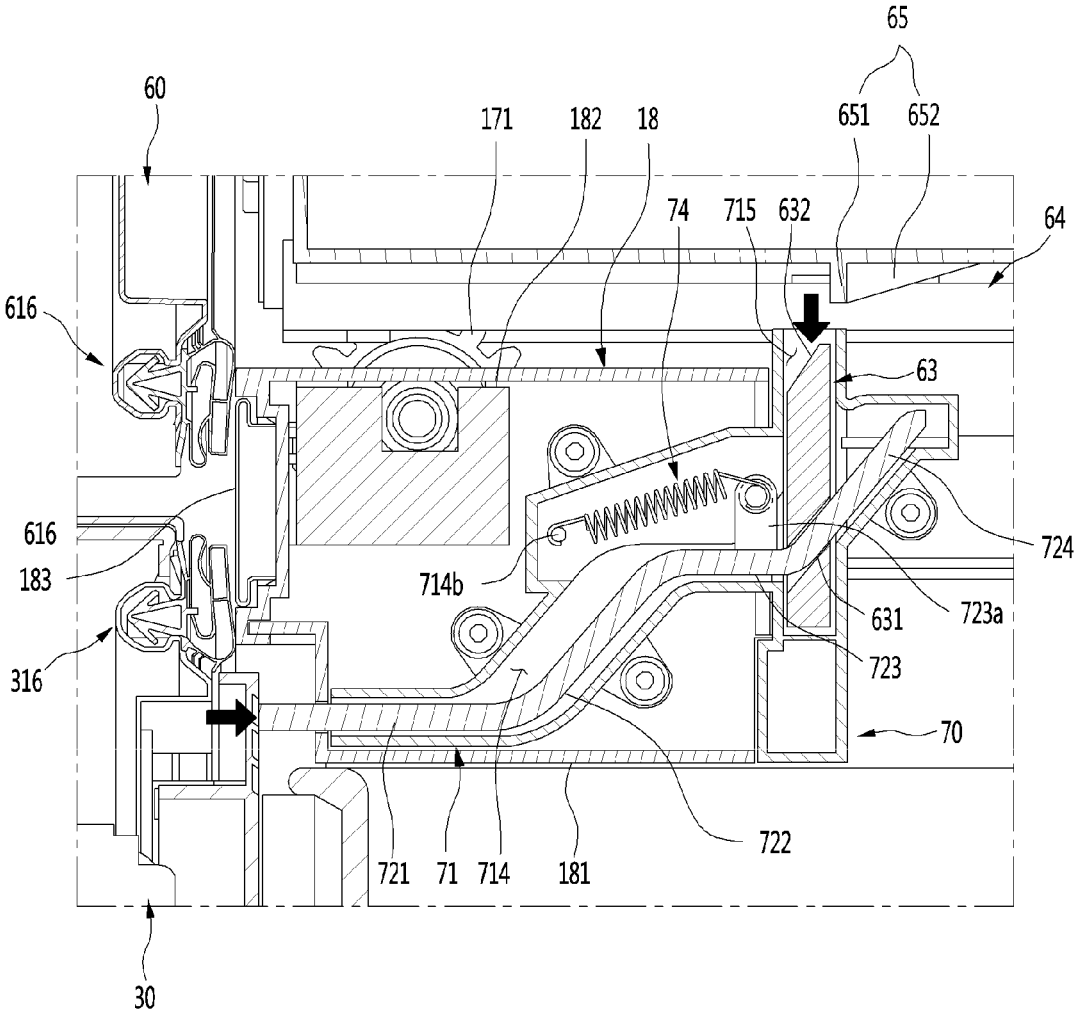
FIG. 20 is an enlarged view illustrating a portion A of FIG. 19.
Figure 21:
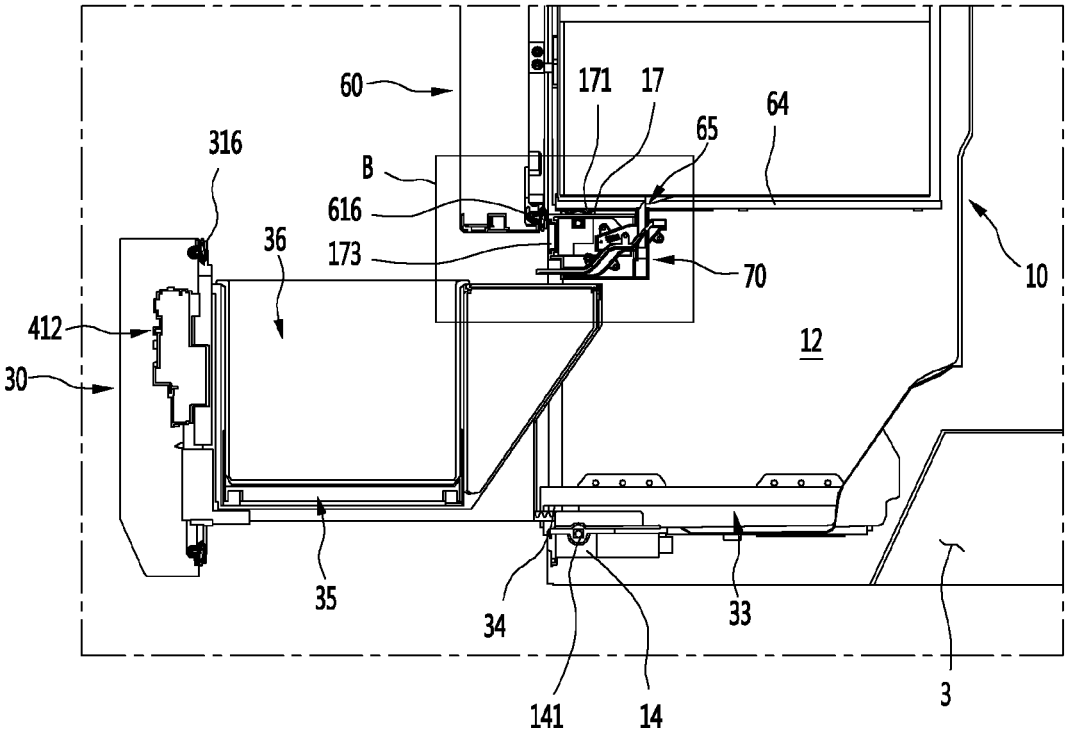
FIG. 21 is a view illustrating a state in which the drawer door is withdrawn to be elevated.

FIG. 19 is a view illustrating a state in which the drawer door is closed. Also, FIG. 20 is an enlarged view illustrating a portion A of FIG. 19.

As illustrated in the drawings, the upper door 60 and the lower door 30 may cover the lower storage chamber 12 in the cabinet 10 when both the upper door 60 and the lower door 30 are closed.

In this state, the gasket 317 may be closely attached to the front surface of the partition member 18 to maintain the sealed state. In addition, the rear surface of the door part 31 of the lower door 30 may be maintained in contact with the upper door restriction unit 70 and may be in a state in which the rear surface presses the pushing member 72.

That is, the push member 72 may be disposed at the rearmost position inside the upper restriction unit case 71, and the upper elastic member 74 may be tensioned to its maximum length. Also, the first slider 73 may be disposed below the second inclined part 724 and may be disposed at the lowest position inside the first slider accommodation part 715.

Thus, the upper end of the first slider 73 may not contact the door restriction part 65 disposed on the bottom surface of the upper door 60 and may be disposed at a lower position than the lower end of the door restriction part 65 so as not to interfere with the upper door 60 when the upper door 60 is inserted and withdrawn.

In this state, the upper door 60 may be withdrawn forward by user's manipulation and then may be inserted again after being withdrawn. In some cases, the upper draw-out motor 17 may be driven by the user's manipulation, and the upper pinion 171 may move along the upper draw-out rack 64 so that the upper door 60 is automatically inserted and withdrawn.

The draw-out motor 14 of the lower door 30 may also be driven by the user, and the pinion 141 may move along the draw-out rack 34 so that the lower door 30 is automatically inserted and withdrawn. Also, the lower door 30 may operate to elevate the elevation member 35 in the withdrawn state.

Figure 22:
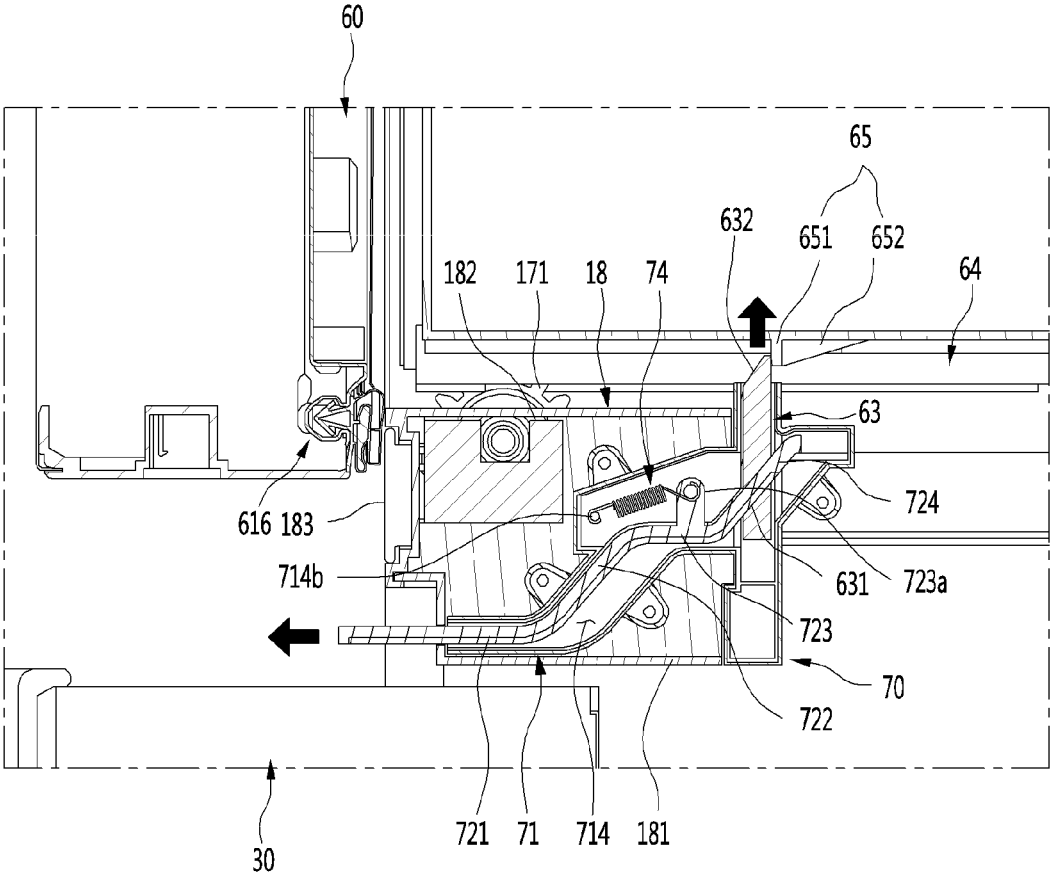
FIG. 22 is an enlarged view illustrating a portion B of FIG. 21.

FIG. 22 is a view illustrating a state in which the drawer door is closed.

As illustrated in the drawings, the lower door 30 may be withdrawn by the user's manipulation. The draw-out motor 14 may be driven according to the user's input manipulation, and the lower door 30 may be withdrawn forward.

Also, when the lower door 30 is withdrawn by a set distance, the elevation motor 411 may operate, and power may be transmitted through the door-side device 41 and the drawer-side device 50. Thus, the elevation member 35 may be elevated.

The door part 31 is moved forward at the same time when the drawer door 30 is withdrawn. Thus, the door part 31 of the lower door 30 may be separated from the push member 72. When the force of the lower door 30 pressing the push member 72 is removed, the push member 72 may move forward due to the elastic force of the upper elastic member 74. Also, the forward movement of the push member 72 may be guided by the guide groove 724*a* and the movement guide 714*c* of the push member 72 when the push member 72 moves forward.

As the push member 72 moves forward, the first slider 73 passing through the second inclined part 724 may move upward. The first slider 73 may be accommodated in the first slider accommodation part 715 and be movable only in the vertical direction. When the second inclined part 724 moves forward, the inclined inner top and bottom surfaces of the through-hole 731 may move along the inclined surface of the second inclined part 724.

Figure 23:
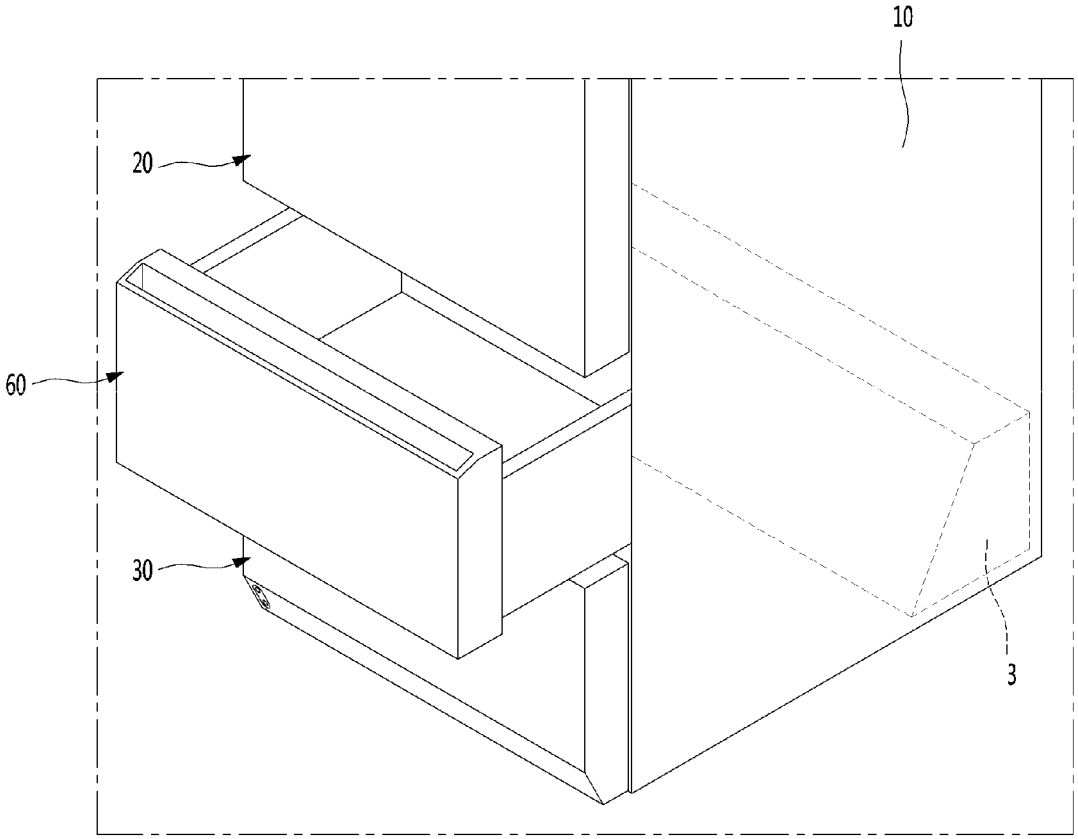
FIG. 23 is a perspective view illustrating a state in which the lower drawer is withdrawn.

Thus, the first slider 73 may move upward, and the upper end of the first slider 73 may protrude upward through the first slider opening 715*a*. The protruding upper end of the first slider 73 may be hooked with the front surface of the door restriction part 65 at the front side of the door restriction part 65 as shown in FIG. 23. Thus, the forward movement of the upper door 60 may be restricted.

The push member 72 may move forward by the upper elastic member 74 at the same time when the lower door 30 is withdrawn, and the first slider 73 may move upward simultaneously with the movement of the push member 72 so as to be hooked the door restriction part 65 and be restricted.

That is, since the upper door 60 is restricted at the same time when the lower door 30 is withdrawn, the upper door 60 may not be withdrawn forward when the lower door 30 starts to be withdrawn.

Thus, since the lower door 30 ascends after being withdrawn forward, in the state in which the lower door 30 ascends, the lower door 30 may be prevented in principle from colliding or interfering with the upper door 60 in the state of being withdrawn.

FIG. 23 is a perspective view illustrating a state in which the lower drawer is withdrawn.

As illustrated in the drawing, when a user wants to store food on the upper door 60, the user can withdraw and insert the upper door 60. It is possible to hold the handle recessed on the upper end of the upper door 60 and pull and withdraw the upper door 60 in order to withdraw the upper door 60.

In the state in which the upper door 60 is withdrawn, it may be preferable that the lower door 30 remain closed. This is because when the lower door 30 is withdrawn in the state in which the upper door 60 is withdrawn, the center of gravity of the refrigerator 1 moves forward and so the refrigerator 1 may fall over in a forward direction. Particularly, when heavy food is accommodated in the upper door 60 and the lower door 30, the possibility that the refrigerator 1 falls down forward is further increased.

Thus, when the upper doors 60 is withdrawn, the lower door 30 may remain closed in a restricted state. For this, when the upper door 60 is withdrawn, the lower door restriction unit 80 can be correspondingly operated, thereby restricting the lower door 30.

Accordingly, as described above, in the state in the lower door 30 is withdrawn, the upper door 60 can be restricted.

Thus, when any one of the upper door 60 and the lower door 30 is withdrawn, the other one can be maintained in the restricted state. That is, the upper door 60 and the lower door 30 may be prevented from being withdrawn from the refrigerator 1 at the same time, thereby helping to avoid a situation in which the refrigerator may fall over.

Hereafter, the lower door restriction unit will be described in more detail with reference to the drawings.

Figure 24:
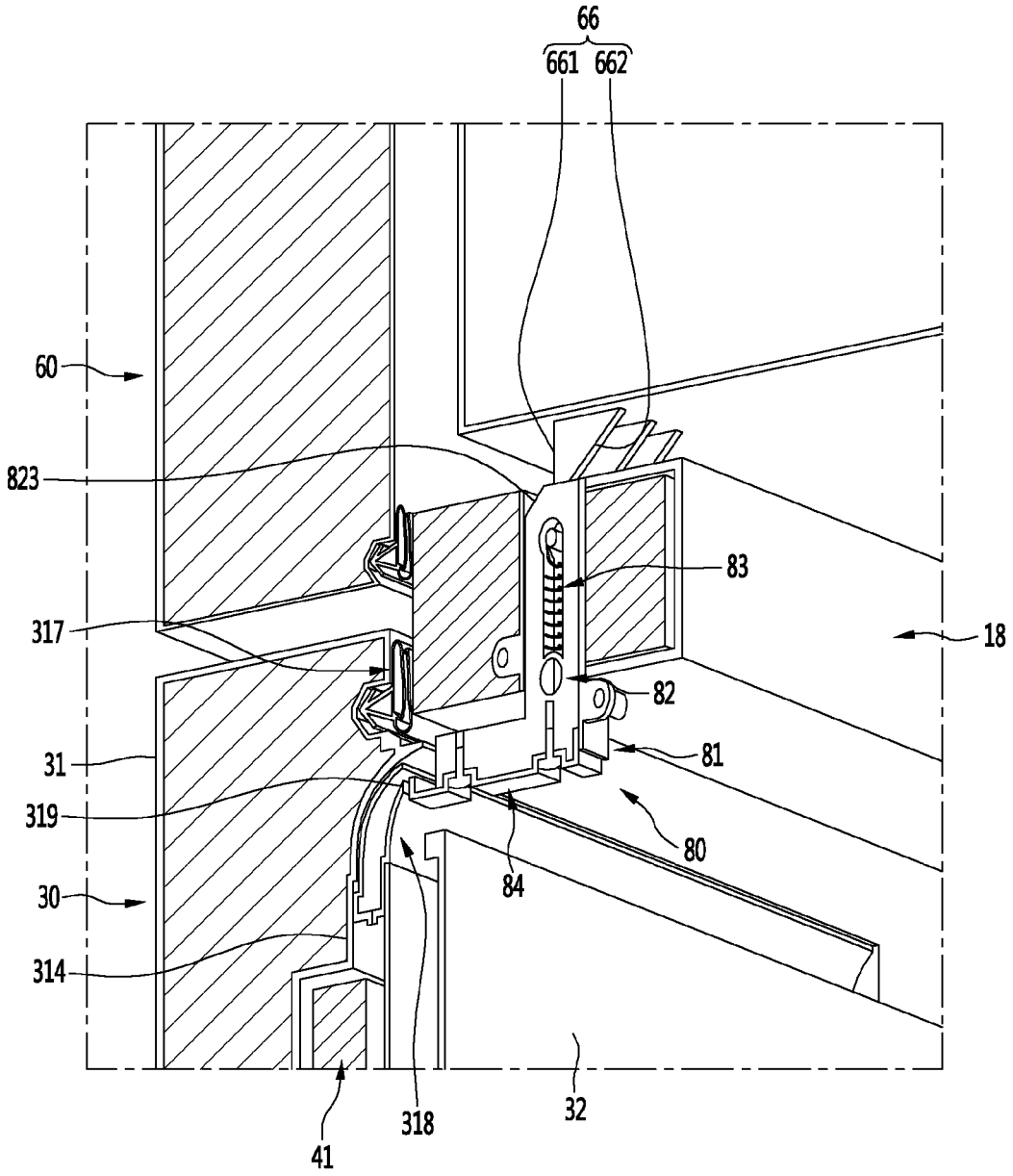
FIG. 24 is a cutaway perspective view illustrating a state in which the lower drawer restriction unit according to an implementation is mounted.
Figure 25:
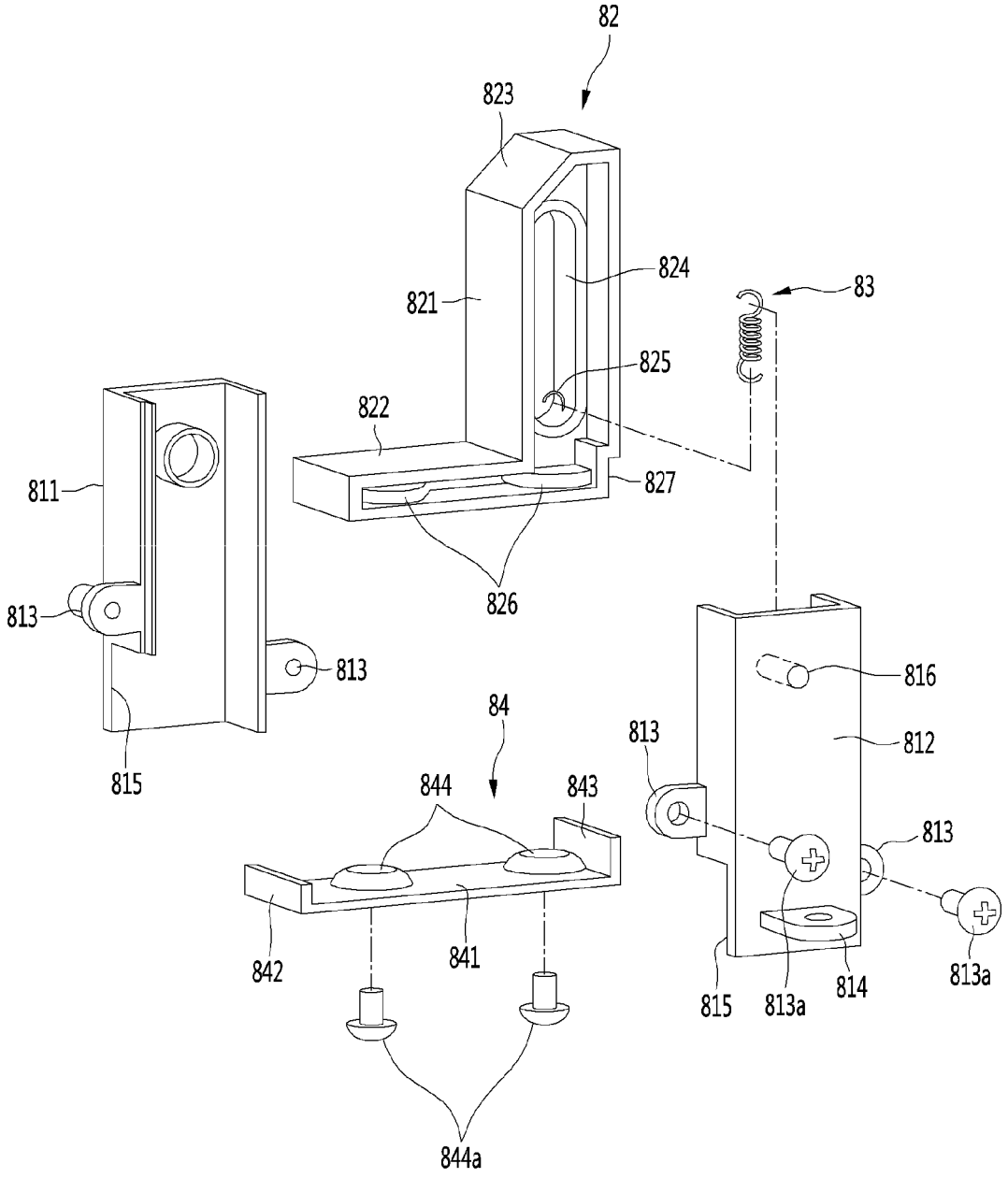
FIG. 25 is an exploded perspective view illustrating the coupling structure of the lower door restriction unit.

FIG. 24 is a cutaway perspective view illustrating a state in which the lower drawer restriction unit according to an implementation is installed on the refrigerator. Also, FIG. 25 is an exploded perspective view illustrating the coupling structure of the lower door restriction unit.

As illustrated in the drawings, a door liner 314 may be formed on the rear surface of the door part 31 of the lower door 30 and a restriction groove 319 that is restricted by the lower door restriction unit 80 may be formed at the upper portion of the rear surface of the door part 31.

The restriction groove 319 may be formed on the upper end of the door liner 314 and may be positioned between the gasket 317 formed on the door part 31 and the upper end of the drawer part 32. In some cases, the restriction groove 319 may be positioned slightly below the partition member 18 at a position adjacent to the partition member 18. Thus, the lower door restriction unit 80 mounted on the partition member 18 may more easily restrict the lower door 30.

The restriction groove 319 may have a shape that is open downward and may have a structure in which the front end of the locking member 84 (to be described below) is selectively restricted with the inner side of the restriction groove 319. Also, when a door light 318 is positioned at the upper end of the rear surface of the door part 31, the position of the door light 318 may include the position where the restriction groove 319 is formed. In this case, the restriction groove 319 may be recessed at a side of the door light 318.

The upper draw-out racks 64 longitudinally extend on both the left and right sides of the bottom surface of the upper door 60. Also, an upper restriction protrusion 66 may be formed between the upper draw-out racks 64.

The upper restriction protrusion 66 may be positioned over the partition member 18 and may be formed at a position where the upper restriction protrusion can be restricted with the upper end of the upper door restriction unit 70 in the state in which the upper doors 60 is closed. In some cases, the upper restriction protrusion 66 may be formed at a position where upper restriction protrusion can be restricted with the upper end of the second slider 82 of the upper door restriction unit 70 in the state in which the lower door 30 is open.

The upper restriction protrusion 66 may protrude downward from the bottom surface of the upper door 60. The upper restriction protrusion 66 may be formed in a plate shape, and may be formed in plurality with regular intervals, so they may be effectively in contact with the upper end of the second slider 82. The upper restriction protrusions 66 may have a width corresponding to the second slider 82 to thereby interfere with each other.

The upper restriction protrusion 66 may include a vertical part 661 and an inclined part 662. The vertical part 661 may form the front surface of the upper restriction protrusion 66 and may perpendicularly extend from the bottom surface of the drawer part 32 of the upper door 60. Thus, in a state in which the second slider 82 ascends, the upper restriction protrusion may be restricted in contact with the rear surface of the second slider 82 and may restrict forward movement of the upper door 60.

Also, the inclined part 662 may form the rear surface of the upper restriction protrusion 66 and may have an inclination that goes to the rear as it goes upward. Also, the inclined part 662 may have an inclination corresponding to the inclined surface 823 of the front surface of the second slider 82. Thus, when the upper door 60 is closed from the withdrawn state, the inclined part 662 comes in contact with the inclined surface 823, thereby being able to push and move the second slider 82 downward.

Based on this structural configuration, when the upper door 60 is inserted after withdrawn, even if the second slider 82 protrudes upward, the upper restriction protrusion 66 may pass while moving the second slider 82 downward.

The lower door restriction unit 80 may include a lower restriction unit case 81 that forms the outer appearance, a second slider 82 that is positioned in the lower restriction unit case 81, and a locking member 84 that is mounted on the lower end of the second slider 82.

In some implementations, the lower restriction unit case 81 may be mounted on the inner side of the partition member 18 and may be formed such that the second slider 82 can be accommodated therein. Also, the lower restriction unit case 81 may be open on the top surface and the bottom surface such that the upper end and the lower end of the second slider 82 can be exposed respectively through the top surface and the bottom surface of the lower restriction unit case 81.

In some implementations, the lower restriction unit case 81 may include a left case 811 and a right case 812. A space in which the second slider 82 can be accommodated is formed in the lower restriction unit case 81 by coupling the left case 811 and the right case 812. Also, case coupling parts 813 that are coupled to each other by a screw 813*a* may be formed on the left case 811 and the right case 812. The left case 811 and the right case 812 may be coupled in a state in which the second slider 82 is accommodated therein by the case coupling parts 813. Also, the second case mounting parts 814 to which the second mounting boss 189 is coupled may protrude on the left case 811 and the right case 812.

A case cut part 815 that is cut such that the lower portion of the second slider 82 protrude forward may be formed at the lower ends of the left case 811 and the right case 812. The case cut portion 815 may protrude from a side to the lower end of the lower restriction unit case 81 such that a portion of the second slider protrudes forward.

Also, the case cut part 815 may be cut larger than the thickness of the lower part 822 forming the lower end of the second slider 82 such that the second slider 82 is not interfered with the lower part 822 when vertically moving.

Also, upper fixing parts 816 that face each other may be formed at the upper portions of the inner side surface of the left case 811 and the right case 812. The upper fixing parts 816 may be formed to protrude on at least one of the left case 811 and the right case 812 such that the upper end of a lower elastic member 83 for providing elasticity to the second slider 82 can be fixed. The upper fixing parts 816 may be disposed to connect the left case 811 and the right case 812 and may be formed through the second slider 82.

The second slider 82 may be composed of an upper part 821 and a lower part 822. The upper part 821 is characterized by vertically extending and the lower part 822 is characterized by extending in a direction crossing the upper part 821 at the lower end of the upper part 821.

The second slider 82 is formed to have a predetermined thickness or width and can easily come in contact with the upper restriction protrusion 66, so the second slider 82 can be effectively restricted with the upper restriction protrusion 66 in a restriction situation and can move over the upper restriction protrusion 66 in a non-restriction situation.

Also, in order to sufficiently transmit force that is applied in a state in which the upper door 60 and the lower door 30 are restricted, the second slider 82 may be made of a plastic material or an engineering plastic material.

The upper part 821 may be formed to be able to be accommodated in the lower restriction unit case 81 and may be vertically elongated. Also, an inclined surface 823 may be provided on the upper end of the upper part 821. The inclined surface 823 may be formed on the edge surfaces of the front surface and the top surface of the upper part 821 and may be formed to have an inclination corresponding to the inclined part 662 of the upper restriction protrusion 66. The inclined surface 823 may be disposed to face the front.

In some implementations, the rear surface of the upper part 821 may be formed in parallel with the vertical part 661. The rear surface of the upper part 821 may be positioned ahead of or in the same line with the vertical part 661 in the state in which the lower door 30 is closed.

A guide slot 824 passing through both the left and right sides of the upper part 821 may be formed in the upper part 821. The guide slot 824 may vertically extend along the upper part 821.

The guide slot 824, which is designed to guide a vertical movement of the second slider 82, may be formed such that the upper fixing parts 816 formed on the inner side of the lower restriction unit case 81 pass through the guide slot 824. Thus, when the second slider 82 vertically moves, the upper fixing parts 816 can move along the guide slot 824.

Lower fixing parts 825 to which the lower end of the lower elastic member 83 may be formed at the lower end of the inner side of the guide slot 824. In the upper fixing parts 816 are inserted in the guide slot 824, the lower fixing parts 825 may be positioned below the upper fixing parts 816. Also, the upper fixing parts 816 and the lower fixing parts 815 move close to or far away from each other in accordance with vertical movement of the second slider 82.

In some cases, the lower elastic member 83 may be positioned inside the guide slot 824. The lower elastic member 83 allows the second slider 82 to return to the initial position by providing elasticity when the second slider 82 moves.

The lower elastic member 83 may be a coil spring. The upper end of the lower elastic member 83 may be coupled to the upper fixing parts 816 and the lower end of the lower elastic member 83 may be coupled to the lower fixing parts 825.

Thus, in the state in which the second slider 82 moves downward, the lower elastic member 83 may become tensioned. When external force is not applied to the second slider 82 by the restoring force of the lower elastic member 83, the second slider 82 can move upward. That is, in the state in which external force is not applied to the second slider 82, the top surface of the second slider 82 may be positioned at the upper end of the lower restriction unit case 81, and the bottom surface of the upper restriction protrusion 66 and the upper end of the second slider 82 may be maintained in a contact state.

The lower part 822 may be perpendicularly extended forward from the lower end of the upper part 821. The lower part 822 may extend through the case cut part 825 and may extend a length such that the lower part can be inserted in the restriction groove 319 formed on the rear surface of the lower door 30 in the state in which the lower door 30 is closed.

Screw fastening parts 826 may be formed on the lower part 822. The screw fastening parts 826 are longitudinally spaced and are formed such that a screw 844*a* that is fastened through the locking member 84 can be fastened. Thus, the locking member 84 can be fixed and mounted to the bottom surface of the lower part 822.

The locking member 84, which is mounted on the lower end of the second slider 82 and selectively coupled to the restriction groove 319 formed on the rear surface of the lower door 30 to restrict the lower door 30, may be fixed and mounted to the bottom surface of the lower part 822. In some implementations, the locking member 95 may be formed integrally with the second slider 82 and a portion of the second slider 82 may be restricted in the restriction groove.

The locking member 84 may be made of a metal material not to be damaged even by a shock that is repeatedly applied when the lower door 30 is closed. The locking member 84 may be formed by bending both ends of a metal plate and may be composed of a bottom surface part 841 being in contact with the bottom surface of the upper part 821, a front surface part 842 bent upward from the front end of the lower surface part 841, and a rear surface part 843 bent upward from the rear end of the lower surface part 841.

A screw hole 844 may be formed on the bottom surface part of the locking member 84 at a position corresponding to the screw fastening part 826 such that the locking member 84 can be fixed and mounted to the bottom surface of the lower part 822 by fastening the screw 844*a* from under. The locking member 84 may form the bottom surface of the second slider 82 and may be exposed below the lower door restriction unit 80.

Also, the bottom surface part 841 may protrude further than the front end of the lower part 822 and the front surface part 842 may perpendicularly bent upward from the protruding end. Thus, the front end of the locking member 84 may be formed in a shape like a ring and can be restricted in a state in which the front end is inserted in the restriction groove 319 formed on the rear surface of the lower door 30. When the locking member 84 is formed integrally with the second slider 82, the lower end of the second slider 82 is formed in the shape of the locking member 84 and in the ring shape like the front surface part 842, thereby being able to be restricted in the restriction groove 319.

Also, the rear surface part 843 is perpendicularly bent upward from the lower end of the bottom surface part 841 and may be seated on a stepped part 827 stepped at the edge of the lower end of the rear surface of the second slider 82.

Hereafter, the operation of the lower door restriction unit 80 will be described in more detail with reference to the drawings.

Figure 26:
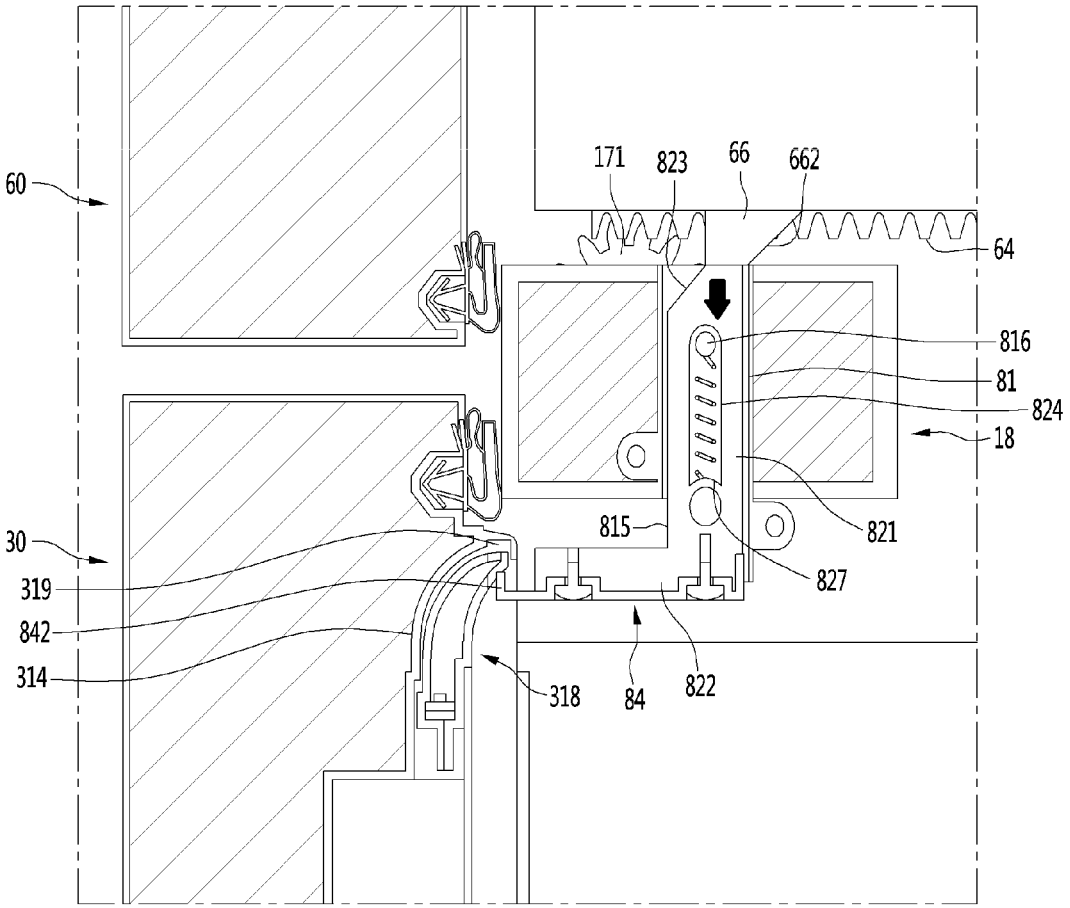
FIG. 26 is a cross-sectional view illustrating a state in which the lower door restriction unit is not restricted.
Figure 27:
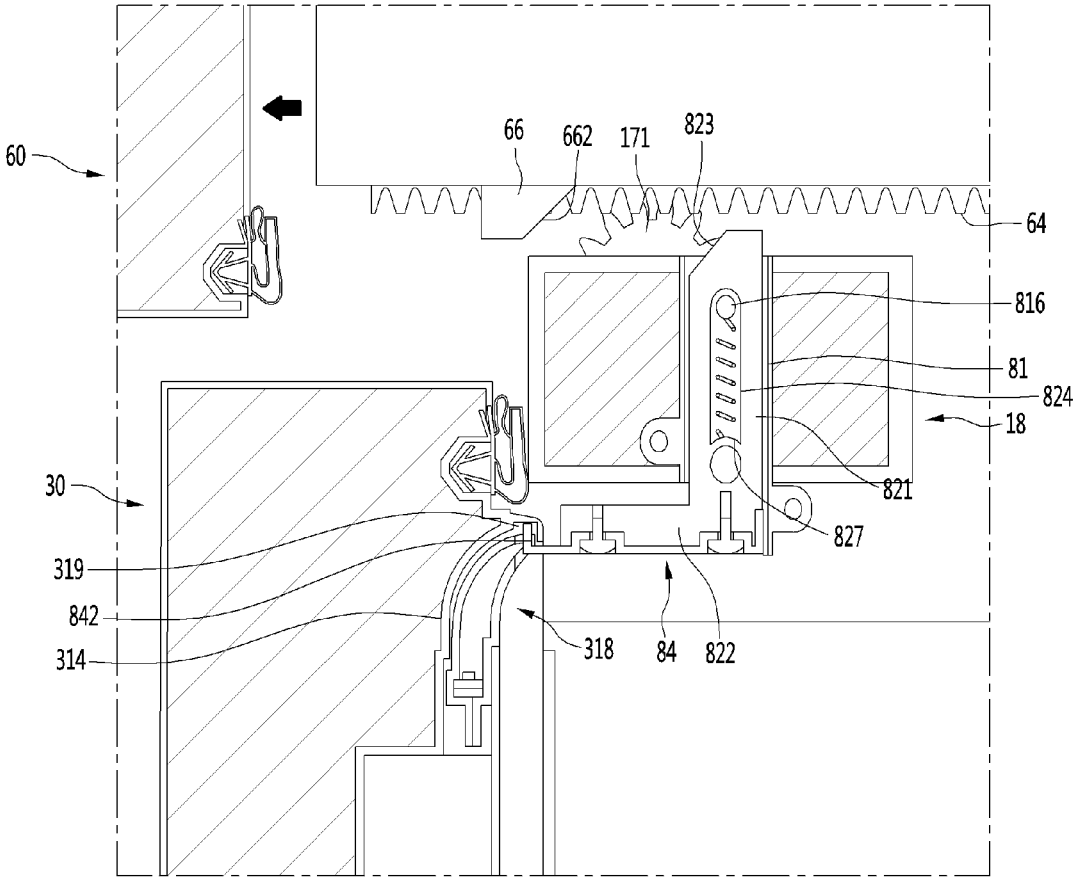
FIG. 27 is a cross-sectional view illustrating a state in which the lower door restriction unit is restricted.
Figure 28:
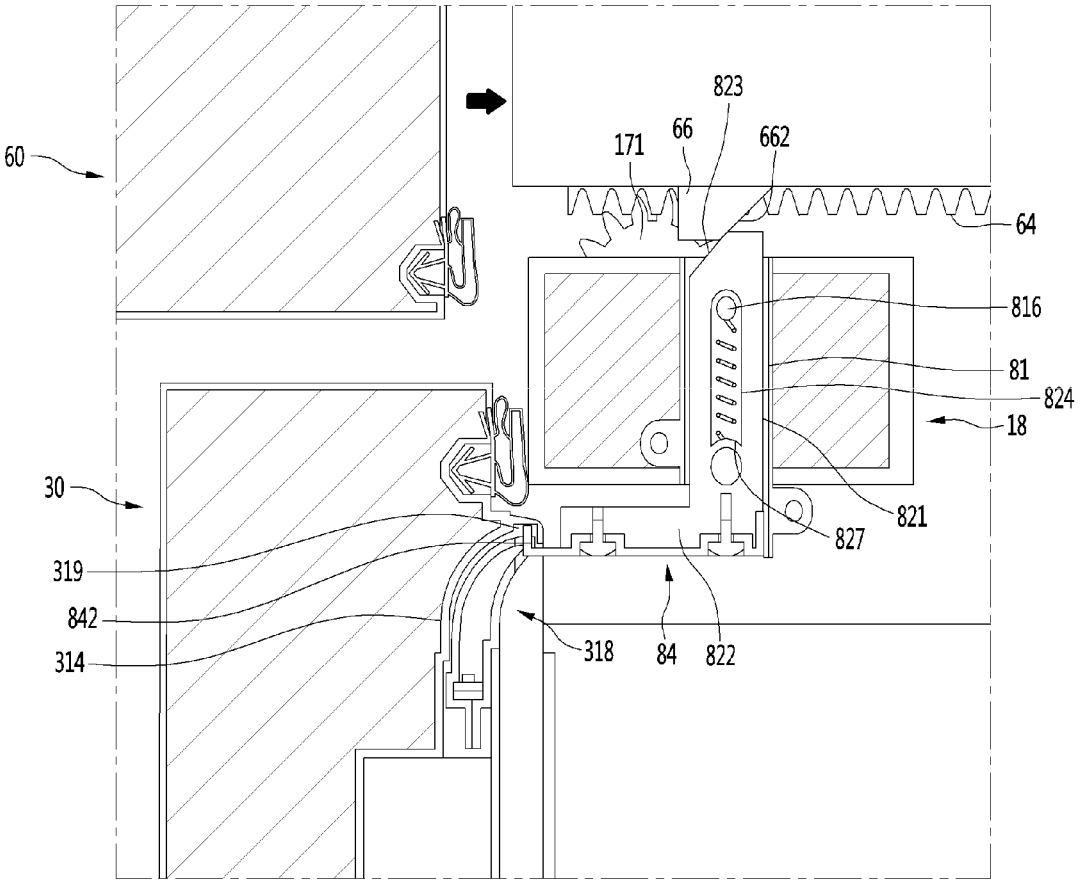
FIG. 28 is a cross-sectional view illustrating a state in which the upper door is inserted after withdrawn.

FIG. 26 is a cross-sectional view illustrating a state in which the lower door restriction unit is not restricted. Also, FIG. 27 is a cross-sectional view illustrating a state in which the lower door restriction unit is restricted. Also, FIG. 28 is a cross-sectional view illustrating a state in which the upper door is inserted after withdrawn.

As illustrated in FIG. 26, in the state in which both of the upper door 60 and the lower door 30 are closed, the upper door 60 and the lower door 30 are both not restricted, thereby maintaining a state in which withdrawing is possible.

In some implementations, in the state in which the upper door 60 is closed, the lower end of the upper restriction protrusion 66 may be in a state in which the lower end presses the second slider 82 in contact with the top surface of the second slider 82.

The second slider 82 that is in the state in which the second slider 82 is pressed by the upper restriction protrusion 66 may be in a state in which the second slider 82 is moved down, so the lower elastic member 83 is in a tensioned state. Thus, when external force is removed, the second slider 82 is in a state in which the second slider 82 can be moved upward by the lower elastic member 83.

In the state in which the second slider 82 is moved downward, the locking member 84 mounted on the bottom surface of the second slider 82 may be in a state in which the locking member 84 is moved downward. Thus, the front surface part of the locking member 84 can maintain a state in which the front surface part is not completely inserted in the restriction groove 319. That is, the locking member 84 and the restriction groove 319 are separated from each other. The locking member 84 may be in a state in which the locking member 84 does not restrict the lower door 30.

As described above, in the state in which the upper door 60 is closed, the lower door restriction unit 80 may be in a state in which the lower door restriction unit does not restrict the lower door 30, and thus, the lower door 30 can be withdrawn anytime.

The upper door restriction unit 70 can operate simultaneously with withdrawing of the lower door 30, and as described above, withdrawing of the upper door 60 can be restricted. That is, until the lower door 30 is completely inserted after withdrawn, the upper door 60 can maintain an insertion state and a restricted state.

As illustrated in FIG. 27, in the state in which the lower door 30 is inserted, a user can withdraw the upper door 60 by pulling. When the user pulls the upper door 60, the upper door 60 is withdrawn forward. Also, the upper door 60 can be stably withdrawn forward without moving left and right by the coupling of the upper pinion 171 and the draw-out rack 64.

When the upper door 60 is withdrawn, the upper restriction protrusion 66 pressing the second slider 82 is also moved forward. When the upper restriction protrusion 66 is moved forward while passing the upper end of the second slider 82, the external force pressing down the second slider 82 is moved. Thus, the second slider 82 is moved upward by the restoring force of the tensioned lower elastic member 83.

Also, by the upward movement of the second slider 82, the locking member 84 positioned on the bottom surface of the second slider 82 is also moved upward. When the locking member 84 is moved upward, the front surface part 842 of the front end of the locking member 84 is completely inserted in the restriction groove 319.

The restriction groove 319 and the front surface part 842 are formed in protruding and recessed shapes to be restricted with each other. Thus, the lower door 30 can become a completely restricted state by the locking member 84, and in the state in which the second slider 82 ascends, the lower door 30 is restricted and cannot be withdrawn.

As described above, the process in which as the upper door 60 is withdrawn, the second slider 82 is moved upward and the locking member 84 restricts the lower door 30 is performed simultaneously with opening of the upper door 60. Thus, the lower door 30 is restricted at the same time with the withdrawing manipulation of the upper door 60, and this withdrawn state is maintained until the upper door 60 is completely inserted.

In some implementations, in addition to or in lieu of the above-described the lower door restriction unit 80, the draw-out motor 14 of the lower door 30 may be used to selectively restrict a movement of the lower door 30.

As illustrated in FIG. 28, in the state in which the lower door 30 is restricted and the upper door 60 is withdrawn, when a user finishes storing food in the upper door 60, the user inserts back the upper door 60.

When the user inserts the upper door 60, the upper door 60 is moved backward, and thus, the upper restriction protrusion 66 is also moved backward. Also, since external force is not applied to the second slider 82, the lower elastic member 83 is in a contract state, and thus, the second slider 82 becomes a maximally ascending state.

When the second slider 82 is in the maximally ascending state, the lower part 822 can ascend until it reaches the cut part. In this state, the upper end of the second slider 82 can further protrude than the open top surface of the lower restriction unit case 81 and the top surface of the partition member 18.

As the upper restriction protrusion 66 is moved backward, the upper restriction protrusion 66 can be moved backward. The upper restriction protrusion 66 gradually moves close to the second slider 82. Immediately before the upper door 60 is completely inserted, the upper restriction protrusion 66 comes in contact with the second slider 82.

In some implementations, the inclined part 662 may be formed on the rear surface of the upper restriction protrusion 66 and the inclined surface 823 may be formed on the upper end of the second slider 82. Also, by backward movement of the upper restriction protrusion 66, the inclined part 662 and the inclined surface 823 can come in contact with each other. In the state in which the inclined part 662 and the inclined surface 823 are in contact with each other, when the upper door 60 is further inserted and closed, the inclined surface 823 may be moved along the inclined part 662 and the second slider 82 may be moved downward.

When the upper door 60 is completely closed, the second slider 82 may move down completely to the state illustrated in FIG. 26. Also, the upper door 60 and the lower door 30 can maintain the state in which they both can be opened.

What is claimed is:

1. A refrigerator comprising:

a cabinet that defines a first storage chamber and a second storage chamber, the first storage chamber being positioned above the second storage chamber;

a partition member that separates the first storage chamber and the second storage chamber;

an upper door configured to open and close the first storage chamber;

a lower door configured to open and close the second storage chamber;

an upper door restriction unit configured to, based on the lower door being opened, extend from the second storage chamber to the first storage chamber through the partition member to thereby restrict the upper door from being opened; and a lower door restriction unit configured to, based on the upper door being opened, extend from the first storage chamber to the second storage chamber through the partition member to thereby restrict the lower door from being opened, wherein the lower door restriction unit includes:

a lower restriction unit case that is provided at the partition member and that defines top and bottom openings, a slider that is accommodated in the lower restriction unit case and configured to move up and down therein, the slider being exposed through the top and bottom openings of the lower restriction unit case, respectively, and a lower elastic member having each opposing end connected to the lower restriction unit case and the slider, respectively, and configured to be tensioned based on the slider moving downward.

2. The refrigerator of claim 1, further comprising:

upper pinions that are disposed at left and right sides of the partition member; and upper draw-out racks that are disposed at a bottom surface of the upper door, the upper draw-out racks being configured to be gear coupled to the upper pinions to thereby move together with the upper pinions.

3. The refrigerator of claim 1, wherein the partition member is extended in a left-right direction across an entire width of front end portions of the first storage chamber and the second storage chamber, and the first storage chamber and the second storage chamber are in fluid communication with each other.

4. The refrigerator of claim 1, wherein the upper door restriction unit is provided at the partition member and configured to come in contact with the upper door.

5. The refrigerator of claim 1, wherein the upper door restriction unit protrudes through a top surface of the partition member to restrict the upper door.

6. The refrigerator of claim 1, wherein the slider includes:

an upper part that extends in a vertical direction and that includes an upper end that is configured to become restricted with a bottom surface of the upper door; and a lower part that extends forward from a lower end of the upper part and that is configured to be selectively restricted with a rear surface of the lower door based on the upper part moving up and down.

7. The refrigerator of claim 6, further comprising an upper restriction protrusion that is provided at a lower portion of the upper door, the upper restriction protrusion being configured, based on the upper door being closed, to press down a top surface of the upper part of the slider.

8. The refrigerator of claim 7, wherein a rear surface of the upper restriction protrusion includes an inclined part that is inclined toward a rearward direction, wherein an upper end at a front surface of the upper part includes an inclined surface having an inclination corresponding to the inclined part, and wherein the inclined part and the inclined surface are configured, based on the upper door being drawn in from a drawn-out state, to come into contact with each other to thereby move the slider downward.

9. The refrigerator of claim 6, wherein the upper part defines a guide slot that is extended vertically along a longitudinal direction of the upper part, the guide slot being open toward left and right sides of the upper part, and wherein an inner side surface of the lower restriction unit case includes an upper fixing part that extends through the guide slot and to guide a vertical up-down movement of the slider.

10. The refrigerator of claim 9, wherein the lower elastic member is accommodated inside the guide slot, and wherein the upper end of the lower elastic member is fixed to the upper fixing part and the lower end of the lower elastic member is fixed to a lower fixing part provided at the lower end of the guide slot.

11. The refrigerator of claim 6, wherein a cut part through which the upper part passes is defined at a lower end at a front surface of the lower restriction unit case.

12. The refrigerator of claim 1, wherein a lower end of the slider includes a locking member that protrudes forward, the locking member being configured to be selectively restricted with the lower door by passing in and out of a restriction groove provided at a door rear surface.

13. The refrigerator of claim 12, wherein the locking member has a plate shape and is made from a metal material, the locking member being mounted on a bottom surface of the slider and having a front surface part protruding from a front end of the locking member that is bent upward and configured to be inserted into the restriction groove.

14. The refrigerator of claim 12, wherein the locking member includes:

a bottom surface part that is in contact with a bottom surface of the slider; and a front surface part that is bent upward from a front end of the bottom surface part and is positioned farther forward than a front surface of the slider.

15. The refrigerator of claim 12, wherein the restriction groove is recessed on a rear surface of the lower door at a position that corresponds to a front end of the slider, and is open downward to be restricted with an end portion of the locking member based on the locking member moving up and down.

16. The refrigerator of claim 1, wherein the upper door is configured to rotate to open and close the first storage chamber.

17. The refrigerator of claim 1, further comprising:

an elevation assembly provided in the lower door and configured to elevate a container or a food in the lower door based on the lower door being drawn out.

18. The refrigerator of claim 1, wherein the upper door is configured to, based on closing the first storage chamber, come into contact with the partition member, and wherein the lower door is configured to, based on closing the second storage chamber, come into contact with the partition member.

19. A refrigerator comprising:

a cabinet that defines a first storage chamber and a second storage chamber, the first storage chamber being positioned above the second storage chamber;

a partition member that separates the first storage chamber and the second storage chamber;

an upper door configured to open and close the first storage chamber;

a lower door configured to open and close the second storage chamber; and a door restriction unit provided on the partition member and configured to extend from the second storage chamber to the first storage chamber through the partition member, wherein the door restriction unit is configured to restrict the lower door based on the upper door being opened and to restrict the upper door based on the lower door being opened such that the upper door and the lower door are restricted from being simultaneously opened, and wherein the door restriction unit includes:

a restriction unit case that is provided at the partition member and that defines top and bottom openings, a slider that is accommodated in the restriction unit case and configured to move up and down therein, the slider being exposed through the top and bottom openings of the restriction unit case, respectively, and an elastic member having each opposing end connected to the restriction unit case and the slider, respectively, and configured to be tensioned based on the slider moving downward.

* * * * *